US011840426B2

(12) United States Patent
Heiker et al.

(10) Patent No.: US 11,840,426 B2
(45) Date of Patent: Dec. 12, 2023

(54) LARGE MANIPULATOR WITH VIBRATION DAMPER

(71) Applicant: Putzmeister Engineering GmbH, Aichtal (DE)

(72) Inventors: Mike Heiker, Aichtal (DE); Benjamin Hölzle, Bad Urach (DE)

(73) Assignee: Putzmeister Engineering GmbH, Aichtal (DE)

( * ) Notice: Subject to any disclaimer, the term of this patent is extended or adjusted under 35 U.S.C. 154(b) by 759 days.

(21) Appl. No.: 17/002,841

(22) Filed: Aug. 26, 2020

(65) Prior Publication Data

US 2020/0385242 A1 Dec. 10, 2020

Related U.S. Application Data

(63) Continuation-in-part of application No. PCT/EP2019/054392, filed on Feb. 21, 2019.

(30) Foreign Application Priority Data

Feb. 27, 2018 (DE) ..... 10 2018 104 491.7

(51) Int. Cl.
*B66C 13/06* (2006.01)
*B66C 13/18* (2006.01)
(Continued)

(52) U.S. Cl.
CPC ..... *B66C 13/066* (2013.01); *B66C 13/18* (2013.01); *B66F 9/20* (2013.01); *E04G 21/0436* (2013.01); *E04G 21/0454* (2013.01)

(58) Field of Classification Search
None
See application file for complete search history.

(56) References Cited

U.S. PATENT DOCUMENTS 11,142,886 B2 * 10/2021 Renger ..... E02F 3/907
2010/0095835 A1 * 4/2010 Yuan ..... B66F 11/046 700/282
(Continued)

FOREIGN PATENT DOCUMENTS

AT 514116 A1 10/2014
CN 202689566 U 1/2013
(Continued)

OTHER PUBLICATIONS

English translation of the International Search Report, PCT/EP2019/054392, dated Jun. 26, 2019, 2 pages.
(Continued)

*Primary Examiner* — Redhwan K Mawari
(74) *Attorney, Agent, or Firm* — Bose McKinney & Evans LLP

(57) ABSTRACT

A large manipulator for concrete pumps a distributor boom that includes an articulated boom mounted on the boom pedestal and formed by multiple articulating boom arms with multiple joints for pivoting the boom arms with respect to the boom pedestal or an adjacent boom arm. A control device controls the movement of the articulated boom with the aid of drive unit actuating elements associated with the articulated joints. A device determines the vertical speed $v_{||}$ and/or horizontal speed $v\perp$ of a location on at least one boom arm in a coordinate system referenced to the frame. A device is also provided for determining the articulating angles of the joints. The control device controls the movement of the articulated boom by providing positioning control variables $SD_i$ for the actuating elements of the drive units, which positioning control variables depend on the determined vertical speed $v_{||}$ and/or horizontal speed $v\perp$ of the boom arm location, and on the determined articulating angles $\varepsilon_i$ of the joints, and/or on an angle of rotation $\varepsilon_{18}$ of the boom pedestal about a vertical axis, and on control
(Continued)

signals S for adjusting the distributor boom generated by a controller that can be operated by a boom operator.

17 Claims, 18 Drawing Sheets

(51) Int. Cl.
*B66F 9/20* (2006.01)
*E04G 21/04* (2006.01)

(56) References Cited

U.S. PATENT DOCUMENTS

2013/0189060 A1* 7/2013 Lamonte ..... E02F 3/8825 414/507
2013/0270194 A1* 10/2013 Allen ..... E02F 7/065 96/155
2014/0338233 A1* 11/2014 Albers ..... E02F 3/301 37/308
2015/0321594 A1* 11/2015 Harms, Jr. ..... E02F 3/8816 406/40
2018/0119375 A1* 5/2018 Renger ..... E01H 1/0809
2020/0385242 A1* 12/2020 Heiker ..... B66F 9/20

FOREIGN PATENT DOCUMENTS

CN 103234002 B 12/2014
DE 102015208577 A1 11/2016
EP 1319110 B1 3/2008
EP 2778466 A1 9/2014

OTHER PUBLICATIONS

English translation of the Internation Preliminary Report on Patentability, PCT/EP2019/054392, dated Jun. 10, 2020, 5 pages.

* cited by examiner

89
S
193
Target value memory
Coordinate generator
158
Task 1
t3
Task 2
PS_i
156
Position control
t3
SD_i
t2
PI_i
t2
161
155
152
Task 3
162
Output
Σ
DS_i
Damp-ing v⊥
Input
t1
t2
160
Σ
DS_i
Damp-ing v∥
SW_i
SW90
SW92
SW94
SW96
SW98
SW100
t1
192
154
P_si
P_ki
v̂∥
v̂⊥
ε̂_i 89
S
Task 1
Target value memory
Coordinate generator
158
t3
Task 2
156
Position control
t2
Task 3
162
Output
Damp-ing
155
Input
152
154
192
SW90
SW92
SW94
SW96
SW98
SW100
t1

LARGE MANIPULATOR WITH VIBRATION DAMPER

CROSS REFERENCE TO RELATED APPLICATIONS

This is a continuation-in-part of PCT/EP2019/054392 entitled LARGE MANIPULATOR WITH VIBRATION DAMPER filed Feb. 21, 2019 and which claims priority from DE 10 2018 104 491.7 filed on Feb. 27, 2018 the disclosures of both of which are hereby incorporated herein by reference.

BACKGROUND

The present disclosure relates to a large manipulator for concrete pumps comprising a distributor boom, which comprises an articulated boom, is mounted on a boom pedestal, is made up of multiple boom arms connected to one another in an articulated manner and having a boom tip and multiple joints for pivoting the boom arms with respect to the boom pedestal or an adjacent boom arm, said large manipulator including a control device for controlling the movement of the articulated boom with the aid of drive unit actuating elements for drive units respectively associated with the articulated joints. In this case, the boom pedestal can be arranged on a frame and can be rotatable about a vertical axis. The disclosure also relates to a method for damping the mechanical vibrations of a distributor boom of a large manipulator for concrete pumps.

Such a large manipulator and such a method for damping mechanical vibrations of the distributor boom of a large manipulator for concrete pumps is known from EP 1 319 110 B1. The large manipulator of EP 1 319 110 B1 comprises a distributor boom with an articulated boom composed of at least three boom arms, the boom arms of which can be pivoted to a limited extent about respectively horizontal and parallel articulated axes by means of a drive unit. This large manipulator includes a control device for boom movement with the aid of actuating elements associated with the individual drive units and means for damping mechanical vibrations in the articulated boom. With regard to boom damping in the case of the large manipulator, a time-dependent measured variable derived from the mechanical vibration of the boom arm in question is determined, which measured variable is processed in an evaluation unit to generate a dynamic damping signal and is connected to an actuating element controlling the drive unit in question.

The structure of the distributor boom of such a large manipulator is a resiliently oscillatory system that can be excited to natural oscillations. A resonant excitation of such vibrations can cause the boom tip to vibrate at amplitudes of one meter and more. Vibrations can be excited, for example, through the pulsating operation of a concrete pump and the resulting periodic acceleration and deceleration of the concrete column pushed through the delivery line. As a result, the concrete can no longer be evenly distributed and the worker who guides the end hose is put in danger.

SUMMARY

The present disclosure provides a large manipulator for concrete pumps with a damping behavior that is more stable than known large manipulators and a method for damping the mechanical vibrations of large manipulators that enables undesired vibrations to be efficiently damped regardless of the postures of the large manipulator.

One embodiment comprises a large manipulator for concrete pumps that comprises a distributor boom. The distributor boom comprises an articulated boom which is mounted on a boom pedestal, is made up of multiple boom arms connected to one another in articulated manner, and has a boom tip and multiple joints for pivoting the boom arms with respect to the boom pedestal or an adjacent boom arm. The large manipulator includes a control device for controlling the movement of the articulated boom with the aid of drive unit actuating elements for drive units respectively associated with the articulated joints. In the large manipulator, a device is provided for determining the vertical speed $v_{||}$ of a boom arm location on at least one boom arm in a plane parallel to the articulated boom and in a coordinate system referenced to the frame. Also provided is a device for determining the articulated angles of the joints.

In such a large manipulator, the vertical speed $v_{||}$ of a boom arm location is understood to be the speed of the boom arm location in the direction of gravity.

The control device controls the movement of the articulated boom by providing positioning control variables $SD_i$ for the actuating elements of the drive units, which positioning control variables depend on a vertical speed $v_{||}$ of the boom arm location which has been determined by the device for determining a vertical speed $v_{||}$ of a boom arm location, and on the articulating angles $\varepsilon_i$ of the joints determined by the device for determining the articulating angles of the joints, and on control signals S for adjusting the distributor boom generated by a controller that can be operated by a boom operator.

According to one preferred embodiment of the large manipulator, the control device includes a controller assembly which is coupled to the device for determining the vertical speed of a boom arm location and to the device for determining the articulating angles of the joints and is intended for controlling the actuating elements, and which includes a distributor boom damping routine. In this case, the distributor boom damping routine determines, based on a vertical speed $v_{||}$ of the boom arm location determined by the device for determining the speed, a damping force $F_{D||}$, and divides the damping force determined into component damping forces associated with the individual joints. Based on the component damping forces and from the articulating angles determined using the device for determining the articulating angle $\varepsilon_i$ of the joints of the drive units associated with the articulated joints and from known physical quantities of the distributor boom, damping control variables $DS_i$ for controlling the drive unit actuating elements are then determined for damping the articulated boom are included in the positioning control variables $SD_i$ for the actuating elements of the drive units.

The known physical variables of the distributor boom preferably include the joint kinematics of the joints of the distributor boom and the geometry of the boom arms, in particular their length.

The device for determining the speed of a boom arm location on at least one boom arm in the large manipulator can, in particular, be designed to determine the vertical speed $v_{||}$ of the boom tip of the articulated boom.

In one embodiment, the distributor boom damping routine determines, based on the component damping force associated with a joint and based on the articulating angle $\varepsilon_i$ determined for the joint, a target component damping force $FD_i$ to be generated by means of the drive unit associated with the joint, or a target component damping torque $MD_i$ that can be generated by means of the drive unit associated with the joint.

In particular, the large manipulator can include a device for determining an actual force $F_i$ generated by means of the drive unit associated with the joint, or for determining an actual torque $M_i$ generated by means of the drive unit associated with the joint.

In this context, is advantageous if the distributor boom damping routine includes a control stage that determines the damping control variables $DS_i$ for the drive unit for damping the distributor boom, based on a comparison between the actual force $F_i$ generated by the drive unit and the target component damping force $FD_i$ to be generated, or from a comparison between the actual torque $M_i$ generated by the drive unit and the component target damping torque $MD_i$ to be generated.

This target component damping force $FD_i$ or this target component damping torque $MD_i$ is then generated by means of the drive unit associated with the joint. In this case, the control device in the large manipulator can include a controller that supplies control signals S to the controller assembly, the controller assembly then preferably having a distributor boom posture setpoint routine which translates the control signals S into posture setpoint values $PS_i$ in the form of setpoints for the articulating angles $\varepsilon_i$ of the joints of the distributor boom.

In another embodiment, the controller assembly includes a distributor boom control routine which determines the posture control variables $SD_i$ for the actuating elements of the drive units based on the actual posture values $PI_i$ in the form of actual values of the articulating angles $\varepsilon_i$ of the joints of the distributor boom supplied by the controller assembly and the setpoint values $PS_i$. The distributor boom control routine can, e.g., determine the difference between actual posture values $PI_i$ and target posture values $PS_i$, process this difference in a zero order hold filter and feed it as a controlled variable to a control stage designed as a PI controller (proportional-integral-derivative controller), which outputs the positioning control variables $SD_i$.

The controller assembly preferably has a superimposition routine for superimposing the damping control variables $DS_i$ and the positioning control variables $SD_i$ to form control signals $SW_i$ for the actuating elements of the drive units. In particular, one concept of the invention is that of the superimposition routine being designed as an adding routine which adds the damping control variables $DS_i$ to the positioning control variables $SD_i$.

In addition, the device for determining the vertical speed $v_{||}$ of a boom arm location on at least one boom arm should include a speed sensor arranged on the boom arm and/or an acceleration sensor and/or an angle sensor that detects the position of the boom arm in relation to the direction of gravity.

According to a further embodiment, the large manipulator can comprise a device, e.g., a processor, for calculating the actual forces $F_i$ or actual torques $M_i$ generated by the drive units, in which case the control device includes a controller assembly with a distributor boom vertical damping routine which is continuously supplied with the actual forces $F_i$ or actual torques $M_i$ generated by the drive units, as well as the vertical speed $v_{||}$ determined for the boom arm location and the joint angles $\varepsilon_i$ determined for the articulated joints. The distributor boom vertical damping routine thereby determines a vertical force $F_{||}$ acting on the boom arm location based on the supplied actual forces $F_i$ or actual torques $M_i$ and the supplied joint angles $\varepsilon_i$ of the joints, and known physical variables of the distributor boom. The distributor boom vertical damping routine transfers the vertical force $F_{||}$ acting on the boom arm location into a vertical target speed $v_{||target}$ of the boom arm location. Based on the target vertical speed $v_{||target}$ of the boom arm location and the vertical speed $v_{||}$ determined for the boom arm location, the distributor boom vertical damping routine determines a vertical comparison value $\Delta v_{||}$. This vertical comparison value $\Delta v_{||}$ is then converted into a reverse transformation angular velocity $\dot{\varepsilon}_{i\ Inv}$ of the articulated joint by means of a reverse transformation based on the supplied joint angles $\varepsilon_i$ of the joints and based on known physical variables of the placing boom. The distributor boom vertical damping routine includes a distributor boom control routine which compares the reverse transformation angular velocity $\dot{\varepsilon}_{i\ Inv}$ obtained by reverse transformation of the articulated joints with an actual angular velocity $\dot{\varepsilon}_i$ fed to the distributor boom control routine and, based on this comparison, determines the positioning control variables $SD_i$ for the actuating elements of the drive units.

In an advantageous embodiment of said large manipulator, it is provided that the controller feeds control signals S to the controller assembly, which are converted in the controller assembly into target posture values $PS_i$ in the form of target values of the articulating angles $\varepsilon_i$ of the articulated joints of the distributor boom.

In this case, the device for determining the vertical speed $v_{||}$ of a boom arm location on at least one boom arm is preferably designed to determine the speed of the boom tip of the articulated boom.

It should be noted that the device for determining the vertical speed $v_{||}$ of a boom arm location on at least one boom arm can include a speed sensor and/or acceleration sensor arranged on the boom arm and/or an angle sensor that detects the position of the boom arm in relation to the direction of gravity.

The present disclosure also extends to a large manipulator in which the boom pedestal is arranged on a frame and can be rotated about a vertical axis, the control device being designed for controlling a rotary movement of the boom pedestal about the vertical axis with the aid of at least one actuating element of a drive unit associated with the boom pedestal, in which cases a device for determining the horizontal speed $v\perp$ of a boom arm location in a plane perpendicular to the vertical axis and in a coordinate system referenced to the frame is provided, as well as a device for determining the angle of rotation $\varepsilon_{18}$ of the boom pedestal about the vertical axis, with the control device controlling the movement of the articulated boom by providing positioning variables $SD_{90}$ for the at least one actuating element of the drive unit associated with the boom pedestal, which positioning control variables depending on a horizontal speed $v\perp$ of the boom arm location determined by means of the device for determining the horizontal speed $v\perp$ of a boom arm location, and on control signals S for adjusting the distributor boom which are generated by the device for determining the angle of rotation of the boom pedestal about the vertical axis, and by a controller that can be operated by a boom operator.

A large manipulator of this kind can include a controller assembly that is coupled to the device for determining the horizontal speed $v\perp$ and to the device for determining the articulating angle of the articulated joints, and which is intended for controlling the actuating elements, which actuating elements include a distributor boom damping routine which determines a damping force $F_D\perp$ based on the horizontal speed of the portion of the at least one boom arm determined by the device for determining the horizontal speed $v\perp$, and which determines, based on said damping force $F_D\perp$ and based on the articulating angles determined by means of the device for determining the articulating angles of the articulated joints and from known physical variables of the distributor boom, damping control variables $DS_i$ for the drive unit associated with the boom pedestal, for damping the articulated boom, which control variables enter into the positioning control variables $SD_{90}$ for controlling the at least one actuating element of the drive unit associated with the boom pedestal.

Alternatively, it is also possible for the large manipulator to include a device, e.g., a processor, for calculating the actual force $F_i$ or actual torque $M_i$ generated by means of the drive unit associated with the vertical axis, in which case the control device includes a controller assembly having a distributor boom horizontal damping routine to which the determined actual force $F_i$ generated by the drive unit associated with the vertical axis, or the determined actual torque $M_i$ generated by the drive unit associated with the vertical axis, as well as the determined horizontal speed $v\perp$ of the boom location and the determined articulating angle $\varepsilon_i$ of the articulated joints are continuously supplied, with the distributor boom horizontal damping routine determining, based on the supplied actual force $F_i$ or the supplied actual torque $M_i$ as well as the supplied articulating angles $\varepsilon_i$ of the joints, as well as known physical variables of the distributor boom, a horizontal force $F\perp$ acting on the boom arm location, converting the horizontal force $F\perp$ acting on the boom arm location into a horizontal target speed $v\perp_{Target}$ for the boom arm location, determining, based on the horizontal target speed $v\perp_{Target}$ of the boom arm location and the determined horizontal speed $v\perp$ of the boom arm location, a horizontal comparison value $\Delta v\perp$, converting the horizontal comparison value $\Delta v\perp$, by means of an inverse transformation on the basis of the supplied articulating angles $\varepsilon_i$ of the joints and on the basis of known physical variables of the distributor boom, into an inverse transformation angular velocity $\dot{\varepsilon}_{18\ Inv}$ of the boom pedestal about the vertical axis thereof, whereby the boom horizontal damping routine includes a distributor boom control routine which compares the inverse transformation angular velocity $\dot{\varepsilon}_{18\ Inv}$ of the boom frame about the vertical axis thereof, obtained by inverse transformation, with an actual angular speed $\dot{\varepsilon}_i$ of the articulated joints, fed to the distributor boom control routine, and determining, based on this comparison, the positioning control variables $SD_{90}$ for the drive unit associated with the vertical axis.

In this case, the boom arm location can be a boom tip of the articulated boom. It should be noted that the device for determining the horizontal speed $v\perp$ of the boom arm location on at least one boom arm can include a speed sensor and/or acceleration sensor arranged on the boom arm, and/or an angle sensor that detects the angle of rotation of the boom pedestal about the vertical axis.

Also disclosed herein is a method for damping mechanical vibrations of an articulated boom of a large manipulator for concrete pumps comprising an articulated boom, which is mounted on a boom pedestal and is made up of multiple boom arms connected to one another in an articulated manner and having a boom tip and multiple articulated joints for pivoting the boom arms about respectively horizontal, parallel articulated axes with respect to the boom pedestal or an adjacent boom arm, as well as including a control device for controlling the movement of the articulated boom with the aid of actuating elements for drive units respectively associated with the articulated joints. In this case, the vertical speed $v_{\|}$ of a boom arm location is determined in a plane parallel to the articulated boom and in a coordinate system referenced to the frame. The joint angles of the articulated joints are determined, and positioning control variables $SD_i$ are generated for the actuating elements of the drive units, which positioning control variables depend on a vertical speed $v_{\|}$ of the boom arm location determined by the device for determining a vertical speed $v_{\|}$ of a boom arm location, and on the articulating angles $\varepsilon_i$ of the joints determined by means of the device for determining the articulating angles of the joints, and on control signals S for adjusting the distributor boom generated by a controller that can be operated by a boom operator.

In this context, one embodiment includes determining a damping force $F_{D\|}$ based on the vertical speed $v_{\|}$ determined for the boom arm location, the determined damping force $F_{D\|}$ is divided into component damping forces associated with the individual articulated joints, and particular damping control variables $DS_i$ for controlling the drive unit actuating elements for damping the articulated boom, which variables enter into the positioning control variables $SD_i$ for the actuating elements of the drive units, are provided from the component damping forces and from the determined articulating angles $\varepsilon_i$ for the drive units associated with the articulated joints, and from known physical variables of the distributor boom for damping the boom arms.

As an alternative thereto, it is also possible for the actual forces $F_i$ or actual torques $M_i$ generated by the drive units to be determined, the vertical speed $v_{\|}$ of a boom arm location to be determined on at least one boom arm, and the articulating angles $\varepsilon_i$ of the articulated joints to be determined, in which case a vertical force $F_{\|}$ acting on the boom arm location is determined based on the supplied actual forces $F_i$ or actual torques $M_i$ and the supplied articulating angles $\varepsilon_i$ of the joints, as well as from known physical variables of the distributor boom, with the vertical force $F_{\|}$ acting on the boom arm location being converted into a vertical target speed $v_{\|Target}$ for the boom arm location, a vertical comparison value $\Delta v_{\|}$ being determined from the vertical target speed $v_{\|Target}$ of the boom arm location and the vertical speed $v_{\|}$ determined for the boom arm location, the vertical comparison value $\Delta v_{\|}$ being converted, by means of an inverse transformation based on the supplied articulating angle $\varepsilon_i$ of the joints and on the basis of known physical variables of the distributor boom, into an inverse transformation angular velocity $\dot{\varepsilon}_{i\ Inv}$ of the articulated joints, and the inverse transformation angular velocities $\dot{\varepsilon}_{i\ Inv}$ of the articulated joints, obtained by inverse transformation, being compared with the actual angular velocities $\dot{\varepsilon}_i$ of the articulated joints, and positioning control variables SDi for the actuating elements of the drive units being determined from this comparison.

In this case, the vertical speed $v_{\|}$ of the boom tip can be determined as the vertical speed $v_{\|}$ of a boom arm location.

Also disclosed is a method for damping mechanical vibrations of an articulated boom in a large manipulator for concrete pumps, comprising a boom pedestal that is arranged on a frame and is rotatable on the frame about a vertical axis, comprising an articulated boom which is mounted on the boom pedestal and is made up of multiple boom arms connected to one another in an articulated manner, and having a boom tip and multiple articulated joints for pivoting the boom arms about respectively horizontal and mutually parallel articulated axes with respect to the boom pedestal or an adjacent boom arm, and comprising a control device for controlling the movement of the articulated boom about the vertical axis by means of an actuating element of a drive unit associated with the vertical axis, in which the horizontal speed $v\perp$ of a boom arm location is determined in a plane perpendicular to the vertical axis and in a coordinate system referenced to the frame, and in which the articulating angles of the articulated joints are determined, in which case the movement of the articulated boom is controlled by providing positioning control variables $SD_{90}$ for the at least one actuating element of the drive unit associated with the boom pedestal, which control variables are dependent on a horizontal speed v⊥ of the boom arm location determined by means of the device for determining the horizontal speed v⊥, and on control signals S for adjusting the placing boom which are generated by the device for determining the angle of rotation $\varepsilon_{18}$ of the boom pedestal about the vertical axis, and by a controller that can be operated by a boom operator.

In this case, according to an advantageous embodiment of this method, a damping force $F_D\perp$ is determined based on the determined horizontal speed v⊥, and damping control variables $DS_i$ are determined from this damping force $F_D\perp$ and from the determined articulating angles $\varepsilon_i$ for the drive units associated with the articulated joints and from known physical variables of the distributor boom for damping the articulated boom, which control variables are included in the positioning control variables $SD_{90}$ for the at least one actuating element the drive unit associated with the boom pedestal.

Alternatively, it is also possible for the determined actual force $F_i$ generated by the drive unit associated with the vertical axis, or the determined actual torque $M_i$ generated by the drive unit associated with the vertical axis, the horizontal speed v⊥ of a boom arm location on at least one boom arm, and the articulating angle $\varepsilon_i$ of the articulated joints, as well as the angle of rotation $\varepsilon_{18}$ of the boom pedestal about the vertical axis thereof to be determined, in which case a horizontal force F⊥ acting on the boom arm location is determined from the actual force or the supplied actual torque and the supplied articulating angles $\varepsilon_i$ of the joints, as well as from known physical variables of the distributor boom, with the horizontal force F⊥ acting on the boom arm location being converted into a horizontal target speed $v\perp_{Target}$ of the boom arm location, a horizontal comparison value Δv⊥ being determined from the horizontal target speed $v\perp_{Target}$ of the boom arm location and the determined horizontal speed v⊥ of the boom arm location, the horizontal comparison value Δv⊥ being converted, by means of an inverse transformation on the basis of the supplied articulating angles $\varepsilon_i$ of the joints and on the basis of the known physical variables of the distributor boom, into an inverse transformation angular velocity $\dot{\varepsilon}_{18\ Inv}$ of the boom pedestal about the vertical axis thereof, and the inverse transformation angular velocity $\dot{\varepsilon}_{18\ Inv}$ of the boom pedestal about the vertical axis thereof, obtained by inverse transformation, being compared with an actual angular speed $\dot{\varepsilon}_i$ of the articulated joints, supplied to the distributor boom control routine, and determining, based on this comparison, the positioning control variables $SD_{18}$ for the drive unit associated with the vertical axis.

It should be noted that, in particular, the horizontal speed v⊥ of the boom tip can be determined as the horizontal speed v⊥ a boom arm location.

Another disclosed embodiment provides a large manipulator for concrete pumps, comprising a distributor boom (20), which comprises an articulated boom (32) which is mounted on the boom pedestal (30) and is made up of multiple boom arms (44, 46, 48, 50, 52) connected to one another in an articulated manner and having a boom tip (64) and multiple joints (34, 36, 38, 40, 42) for pivoting the boom arms (44, 46, 48, 50, 52) with respect to the boom pedestal (30) or an adjacent boom arm (44, 46, 48, 50, 52), and said large manipulator comprising a control device (86) for controlling the movement of the articulated boom (32) with the aid of drive unit actuating elements (90, 92, 94, 96, 98 100) for drive units (68, 78, 80, 82, 84) respectively associated with the articulated joints (34, 36, 38, 40, 42), comprising a device (102) for determining the vertical speed $v_{\|}$ of a boom arm location on at least one boom arm (44, 46, 48, 50, 52), and comprising a device (116) for determining the articulating angles εi of the joints (34, 36, 38, 40, 42), the control device (86) controlling the movement of the articulated boom (32) by providing control signals $SW_i$ for the actuating elements (90, 92, 94, 96, 98, 100) of the drive units (68, 78, 80, 82, 84), which positioning control variables depend on a vertical speed $v_{\|}$ of a boom arm location determined by the device (102) for determining a vertical speed $v_{\|}$ of a boom arm location, and on the articulating angles $\varepsilon_i$ of the joints (34, 36, 38, 40, 42) determined by means of the device (116) for determining the articulating angles of the joints (34, 36, 38, 40, 42), and on control signals S for adjusting the distributor boom (20) generated by a controller (87) that can be operated by a boom operator, characterized in that the control device (86) includes a controller assembly (89) which is coupled to the device (102) for determining the vertical speed $v_{\|}$ of a boom arm location and to the device (116) for determining the articulating angles $\varepsilon_i$ of the articulated joints (34, 36, 38, 40, 42), includes a distributor boom vertical damping routine (1154), and comprises the device (176) for calculating the actual forces $F_i$ or actual torques $M_i$ generated by the drive units (68, 78, 80, 82, 84), wherein the controller (87) supplies the controller assembly (89') with a control signal S which is converted, in the controller (89), into target posture values $PS_i$ in the form of target values of the articulating angles $\varepsilon_i$ of the articulated joints (34, 36, 38, 40, 42) of the distributor boom (20), wherein the determined actual forces $F_i$ or actual torques $M_i$ generated by the drive units (68, 78, 80, 82, 84), and the vertical speed $v_{\|}$ of the boom arm location are determined by said device (116), and the determined articulating angles $\varepsilon_i$ of the articulated joints (34, 36, 38, 40, 42) are continuously supplied to the distributor boom vertical damping routine (1154), wherein the distributor boom vertical damping routine (1154): determines, based on the supplied actual forces $F_i$ or actual torques $M_i$, and the supplied articulating angles $\varepsilon_i$ of the joints, as well as known physical variables of the distributor boom (20), a vertical force $F_{\|}$ acting on the boom arm location (64), converts the vertical force $F_{\|}$ acting on the boom arm location (64) into a vertical target speed $v_{\|Target}$ for the boom arm location (64), determines a vertical comparison value $\Delta v_{\|}$ between the vertical target speed $v_{\|Target}$ of the boom arm location (64) and the vertical speed $v_{\|}$ determined for the boom arm location (64), the vertical comparison value $\Delta v_{\|}$ being converted, by means of an inverse transformation based on the supplied articulating angles $\varepsilon_i$ of the joints and based on known physical variables of the distributor boom (20) into an inverse transformation angular velocity $\dot{\varepsilon}_{i\ Inv}$ of the articulated joints (34, 36, 38, 40, 42), and the inverse transformation angular velocity $\dot{\varepsilon}_{i\ Inv}$ of the articulated joints (34, 36, 38, 40, 42) then being integrated, in an angular velocity calculation stage (163) designed as an integration stage, over a constant time interval, to form target values of the articulating angles of the joints, defining the target posture values $PS_i$, the controller assembly (89') comprising a distributor boom control routine (1156) which receives target posture values $PI_i$, from an input routine (152), in the form of actual values of the articulating angles $\varepsilon_i$ of the joints (34, 36, 38, 40, 42) determined by the device (116) for determining the articulating angles of the joints (34, 36, 38, 40, 42), and which determines regulated positioning control variables $SD_i$ for the actuating elements (90, 92, 94, 96, 98, 100) of the drive units (68, 78, 80, 82, 84), based on the actual posture values $PI_i$ and the target posture values $PS_i$, by means of a control loop implemented therein, which positioning control variables are converted, in an output routine (162), into the control signals $SW_i$ for the actuating elements (90, 92, 94, 96, 98, 100) of the drive units (68, 78, 80, 82, 84).

Another disclosed embodiment provides a large manipulator for concrete pumps, comprising a boom pedestal (30) that is arranged on a frame (16) and is rotatable, on the frame (16), about a vertical axis (18), comprising a distributor boom (20), which comprises an articulated boom (32) which is mounted on the boom pedestal (30) and is made up of multiple boom arms (44, 46, 48, 50, 52) connected to one another in an articulated manner and having a boom tip (64), and multiple articulated joints (34, 36, 38, 40, 42) for pivoting the boom arms (44, 46, 48, 50, 52) about respectively horizontal and mutually parallel articulating axes with respect to the boom pedestal (30) or an adjacent boom arm (44, 46, 48, 50, 52), and comprising a control device (86) for controlling the movement of the articulated boom (32) about the vertical axis (18) with the aid of an actuating element (90) of a drive unit (26) associated with the vertical axis (18), comprising a device (110) for determining the horizontal speed $v\perp$ of a boom arm location in a plane perpendicular to the vertical axis (18) and in a coordinate system (104) referenced to the frame (16), as well as a device (128) for determining the angle of rotation $\varepsilon_{18}$ of the boom pedestal (30) about the vertical axis (18), wherein the control device (86) controls the movement of the articulated boom (32) by providing control signals $SW_{90}$ for the at least one actuating element (90) for the drive unit (26) associated with the boom pedestal (30), which positioning control variables depend on a horizontal speed $v\perp$ of the boom arm location determined by the device (110) for determining a horizontal speed $v\perp$, and on control signals S for adjusting the distributor boom (20) that are generated by means of the device (128) for determining the angle of rotation $\varepsilon_{18}$ of the boom pedestal (30) about the vertical axis (18), as well as by a controller (87) that can be operated by a boom operator, characterized by a device (176) for calculating the actual torque $M_{18}$ generated by means of the drive unit (26), wherein the controller (87) supplies the controller assembly (89) with control signals S which are converted, in the controller assembly (89), into target posture values $PS_{18}$ in the form of target values of the angle of rotation $\varepsilon_{18}$ of the boom pedestal (30) about the vertical axis (18), and by the control device (86) including a controller assembly (89') including a distributor boom horizontal damping routine (1155), to which the determined actual torque $M_{18}$, generated by the drive unit (26), and the determined horizontal speed $v\perp$ of the boom arm location and the determined angle of rotation $\varepsilon_{18}$ of the boom pedestal (30) about the vertical axis (18), are continuously supplied, wherein the distributor boom horizontal damping routine (1155): determines, based on the supplied actual torques $M_{i8}$, and the supplied angles of rotation $\varepsilon_{18}$ of the boom pedestal (30) about the vertical axis (18), as well as known physical variables of the distributor boom (20), a vertical horizontal force $F\perp$ acting on the boom arm location, converts the horizontal force $F\perp$ acting on the boom arm location (64) into a horizontal target speed $v\perp_{Target}$ of the boom arm location (64), determines a horizontal comparison value $\Delta v\perp$ based on the horizontal target speed $v\perp_{Target}$ of the boom arm location (64) and the determined horizontal speed $v\perp$ of the boom arm location (64), converts the horizontal comparison value $\Delta v\perp$, by means of an inverse transformation on the basis of the supplied angle of rotation $\varepsilon_{18}$ of the boom pedestal (30) about the vertical axis (18) and on the basis of known physical variables of the distributor boom (20), into an inverse transformation angular velocity $\dot{\varepsilon}_{18Inv}$ of the angle of rotation $\varepsilon_{18}$ of the boom pedestal (30) about the vertical axis (18), and the inverse transformation angular velocity $\dot{\varepsilon}_{18Inv}$ of the angle of rotation $\varepsilon_{18}$ of the boom pedestal (30) about the vertical axis (18) is integrated, in an angular velocity calculation stage (163) designed as an integration stage, over a constant time interval, to form a target value of the angle of rotation $\varepsilon_{18}$ defining the target posture values $PS_{18}$, wherein the controller assembly (89') includes a distributor boom control routine (1156) which receives actual posture values $PI_{18}$, from an input routine (152), in the form of actual values from the device (116) for determining the angle of rotation $\varepsilon_{18}$ of the boom pedestal (30) about the vertical axis (18), and determining, by means of a control loop implemented therein, controlled posture values $PG_{18}$, as positioning control variables $SD_{18}$, based on the actual posture values $PI_{18}$ and the target posture values $PS_{18}$, which controlled posture values are converted, in an output routine (162), into the control signals $SW_{90}$ for the actuating element (90) of the drive unit (26) associated with the vertical axis (18).

Yet another disclosed embodiment provides a method for damping mechanical vibrations of an articulated boom (32) of a large manipulator for concrete pumps, comprising a distributor boom (20), which comprises an articulated boom (32) which is mounted on a boom pedestal (30) and is made up of multiple boom arms (44, 46, 48, 50, 52) connected to one another in an articulated manner and having a boom tip (64) and multiple articulated joints (34, 36, 38, 40, 42) for pivoting the boom arms (44, 46, 48, 50, 52) about respectively horizontal and mutually parallel articulating axes with respect to the boom pedestal (30) or an adjacent boom arm (44, 46, 48, 50, 52), in which a movement of the articulated boom (32) is controlled with the aid of actuating elements (90, 92, 94, 96, 98 100) for drive units (26, 68, 78, 80, 82, 84) respectively associated with the articulated joints (34, 36, 38, 40, 42), in which the vertical speed $v_{\parallel}$ of a boom arm location (64) is determined in a plane in parallel with the articulated boom (32) and in a coordinate system (104) referenced to the frame (16), in which the articulating angles of the articulated joints (34, 36, 38, 40, 42) are determined, and in which positioning control variables $SD_i$ for the actuating elements (90, 92, 94, 96, 98, 100) of the drive units (68, 78, 80, 82, 84) are generated, which positioning control variables depend on a vertical speed $v_{\parallel}$ of a boom arm location determined by the device (102) for determining a vertical speed $v_{\parallel}$ of a boom arm location, and on the articulating angles $\varepsilon_i$ of the joints (34, 36, 38, 40, 42) determined by means of the device (116) for determining the articulating angles of the joints (34, 36, 38, 40, 42), and on control signals S for adjusting the distributor boom (20) generated by a controller (87) that can be operated by a boom operator, characterized in that the actual forces $F_i$ or actual torques $M_i$ generated are determined by means of the drive units (68, 78, 80, 82, 84), a vertical force $F_{\parallel}$ acting on the boom arm location (64) is determined based on the actual forces $F_i$ or actual torques $M_i$ supplied and the articulating angles $\varepsilon_i$ supplied for the joints, as well as known physical variables of the distributor boom (20), the vertical speed $v_{\parallel}$ of a boom arm location (64) on at least one boom arm (44, 46, 48, 50, 52) is determined, and the vertical force $F_{\parallel}$ acting on the boom arm location (64) is converted into a vertical target speed $v_{\|Target}$ of the boom arm location (64); a vertical comparison value $\Delta v_{\|}$ is determined based on the target vertical speed $v_{\|Target}$ of the boom arm location (64) and the vertical speed $v_{\|}$ determined for the boom arm location (64), and the vertical comparison value $\Delta v_{\|}$ is converted, by means of an inverse transformation based on the supplied articulating angles $\varepsilon_i$ of the joints and based on known physical variables of the distributor boom (20) into an inverse transformation angular velocity $\dot{\varepsilon}_{i\ Inv}$ of the articulated joints (34, 36, 38, 40, 42), and the inverse transformation angular velocities $\dot{\varepsilon}_{i\ Inv}$ of the articulated joints (34, 36, 38, 40, 42) are integrated, over a constant time interval, to form target values of the articulating angles $\varepsilon_i$ of the joints defining the target posture values $PS_i$ wherein the positioning control variables $SD_i$ for the actuating elements (90, 92, 94, 96, 98, 100) of the drive units (68, 78, 80, 82, 84) are determined, by means of a control loop, based on the actual posture values $PI_i$ and the target posture values $PS_i$, and then being converted into control signals for the actuating elements (90, 92, 94, 96, 98, 100) of the drive units (68, 78, 80, 82, 84).

Still another disclosed embodiment provides a method for damping mechanical vibrations of an articulated boom (32) in a large manipulator for concrete pumps, comprising a boom pedestal (30) that is arranged on a frame (16) and is rotatable, on the frame (16), about a vertical axis (18), comprising a distributor boom (20), which comprises an articulated boom (32) which is mounted on the boom pedestal (30) and is made up of multiple boom arms (44, 46, 48, 50, 52) connected to one another in an articulated manner and having a boom tip (64) and multiple articulated joints (34, 36, 38, 40, 42) for pivoting the boom arms (44, 46, 48, 50, 52) about respectively horizontal and mutually parallel articulating axes with respect to the boom pedestal (30) or an adjacent boom arm (44, 46, 48, 50, 52), in which the movement of the articulated boom (32) about the vertical axis (18) is controlled with the aid of an actuating element (90, 92, 94, 96, 98, 100) of a drive unit (26) associated with the vertical axis (18), wherein the horizontal speed $v\perp$ of a boom arm location is determined in a plane perpendicular to the vertical axis (18) and in a coordinate system (104) referenced to the frame (16), wherein the articulating angles of the articulated joints (34, 36, 38, 40, 42) are determined, and wherein the movement of the articulated boom (32) is controlled by providing positioning control variables $SD_{90}$ for the at least one actuating element (90) for the drive unit (26) associated with the boom pedestal (30), which positioning control variables depend on a horizontal speed $v\perp$ of the boom arm location determined by the device (110) for determining a horizontal speed $v\perp$, and on control signals S for adjusting the distributor boom (20) that are generated by means of the device (128) for determining the angle of rotation $\varepsilon_{18}$ of the boom pedestal (30) about the vertical axis (18), as well as by a controller (87) that can be operated by a boom operator, characterized in that the actual force $F_i$ generated by means of the drive unit (26) associated with the vertical axis (18) or the actual torque $M_i$ generated by means of the drive unit (26) associated with the vertical axis (18) is determined, the horizontal speed $v\perp$ of a boom arm location (64) on at least one boom arm (44, 46, 48, 50, 52) is determined, and the articulating angles $\varepsilon_i$ of the articulated joints (34, 36, 38, 40, 42) and the angle of rotation $\varepsilon_{18}$ of the boom pedestal (30) about the vertical axis (18) thereof are determined, a horizontal force $F\perp$ acting on the boom arm location (64) is determined based on the actual force $F_i$ or the actual torque $M_i$ supplied and the articulating angles $\varepsilon_i$ supplied for the joints, as well as known physical variables of the distributor boom (20), the horizontal force $F\perp$ acting on the boom arm location (64) is converted into a horizontal target speed $v\perp_{Target}$ of the boom arm location (64), wherein a horizontal comparison value $\Delta v\perp$ is determined based on the horizontal target speed $v\perp_{Target}$ of the boom arm location (64) and the horizontal speed $v\perp$ determined for the boom arm location (64), wherein the horizontal comparison value $\Delta v\perp$ is converted, by means of an inverse transformation on the basis of the angle of rotation $\varepsilon_{18}$ supplied for the boom pedestal (30) about the vertical axis (18) and on the basis of known physical variables of the distributor boom (20), into an inverse transformation angular velocity $\dot{\varepsilon}_{18Inv}$ of the boom pedestal (30) about the vertical axis (18) thereof, and the inverse transformation angular velocity $\dot{\varepsilon}_{18Inv}$ of the angle of rotation $\varepsilon_{18}$ of the boom pedestal (30) about the vertical axis (18) being integrated, over a constant time interval, to form a target value of the angle of rotation $\varepsilon_{18}$ defining the target posture value $PS_{18}$, wherein controlled posture values $SD_{18}$, in the form of positioning control variables $SD_{18}$, for the drive unit (26) associated with the boom pedestal (30) are determined based on the actual posture values $PI_{18}$ and the target posture values $PS_{18}$ by means of a control loop, and are converted into control signals $SW_{90}$ for the actuating element (90) of the drive unit (26) associated with the vertical axis (18).

BRIEF DESCRIPTION OF THE DRAWINGS

The above mentioned and other features of this invention, and the manner of attaining them, will become more apparent and the invention itself will be better understood by reference to the following description of embodiments of the invention taken in conjunction with the accompanying drawings, wherein.

Figure 1:
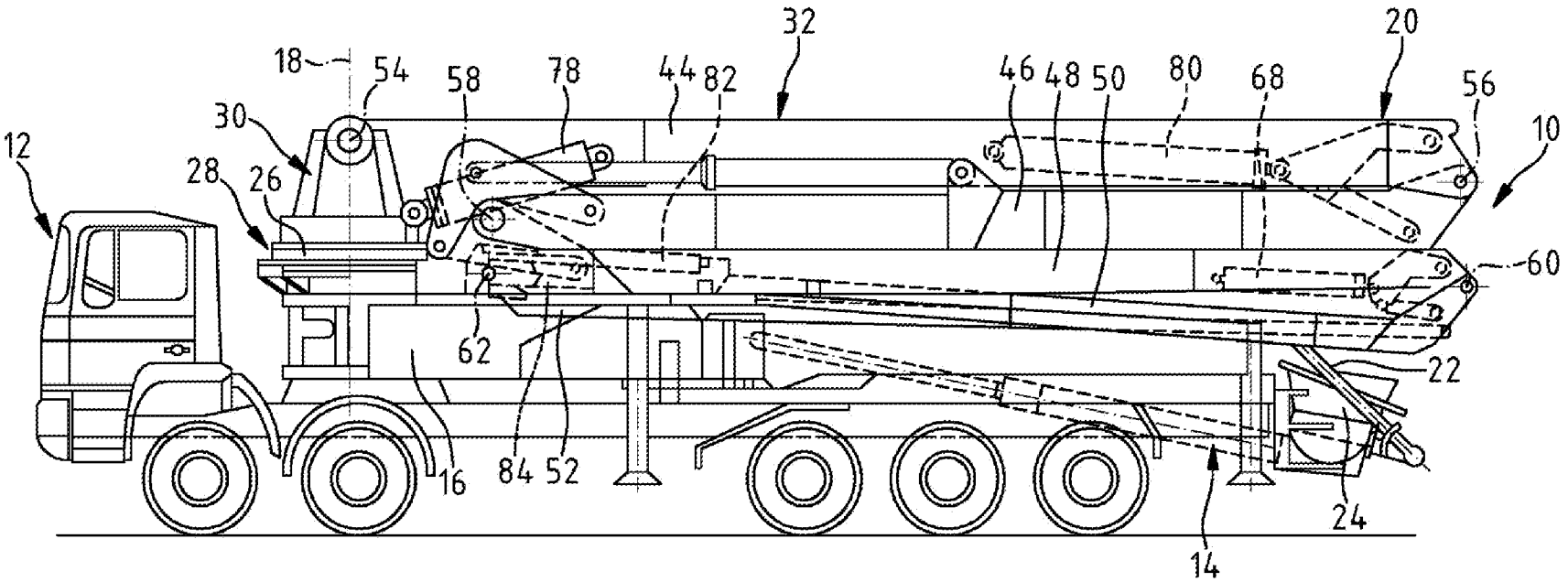
FIG. 1 is a side view of a large manipulator of a truck-mounted concrete pump with a folded distributor boom.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION

Figure 2:
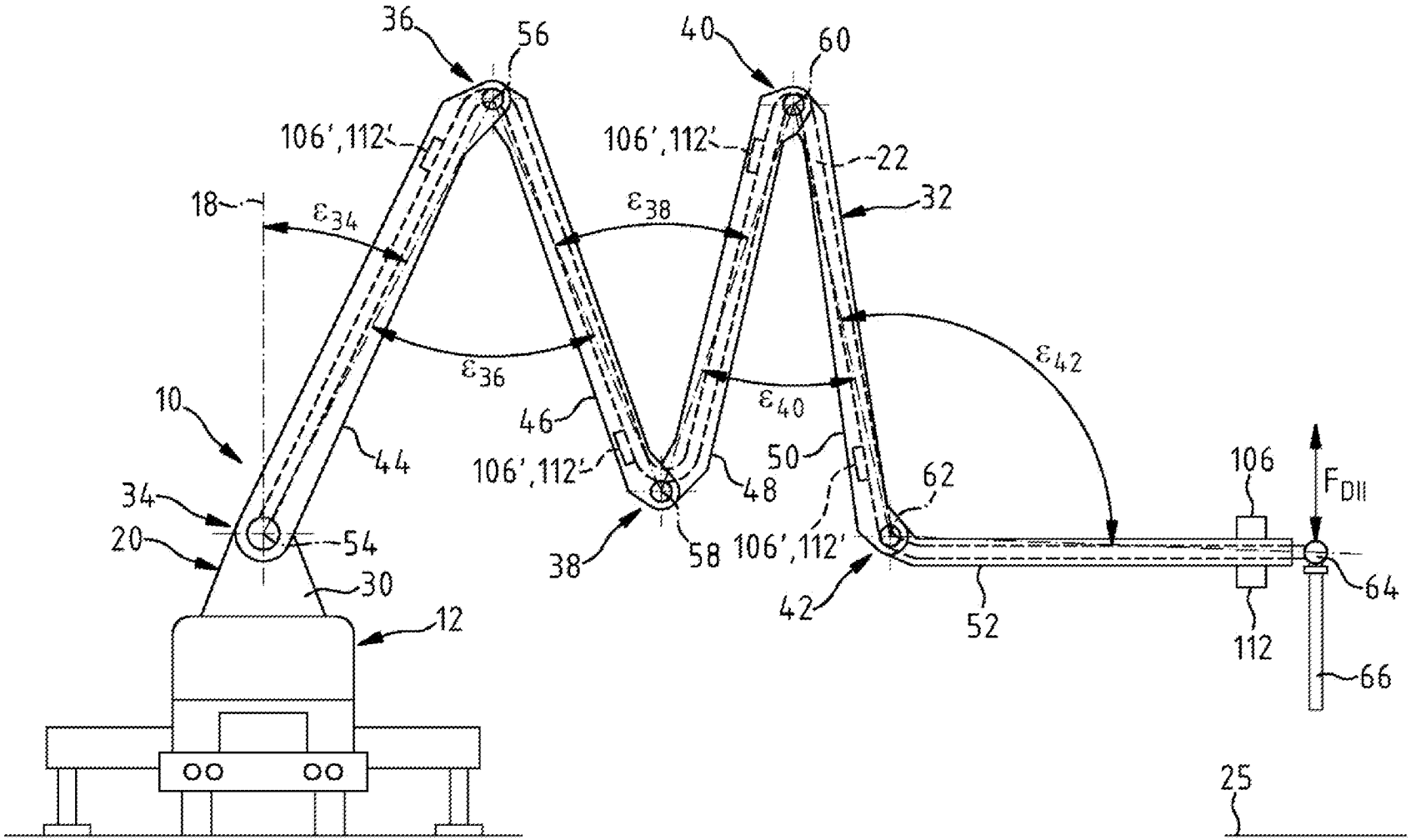
FIG. 2 and FIG. 3 are views of the large manipulator according to FIG. 1 with the distributor boom in various working positions.
Figure 3:
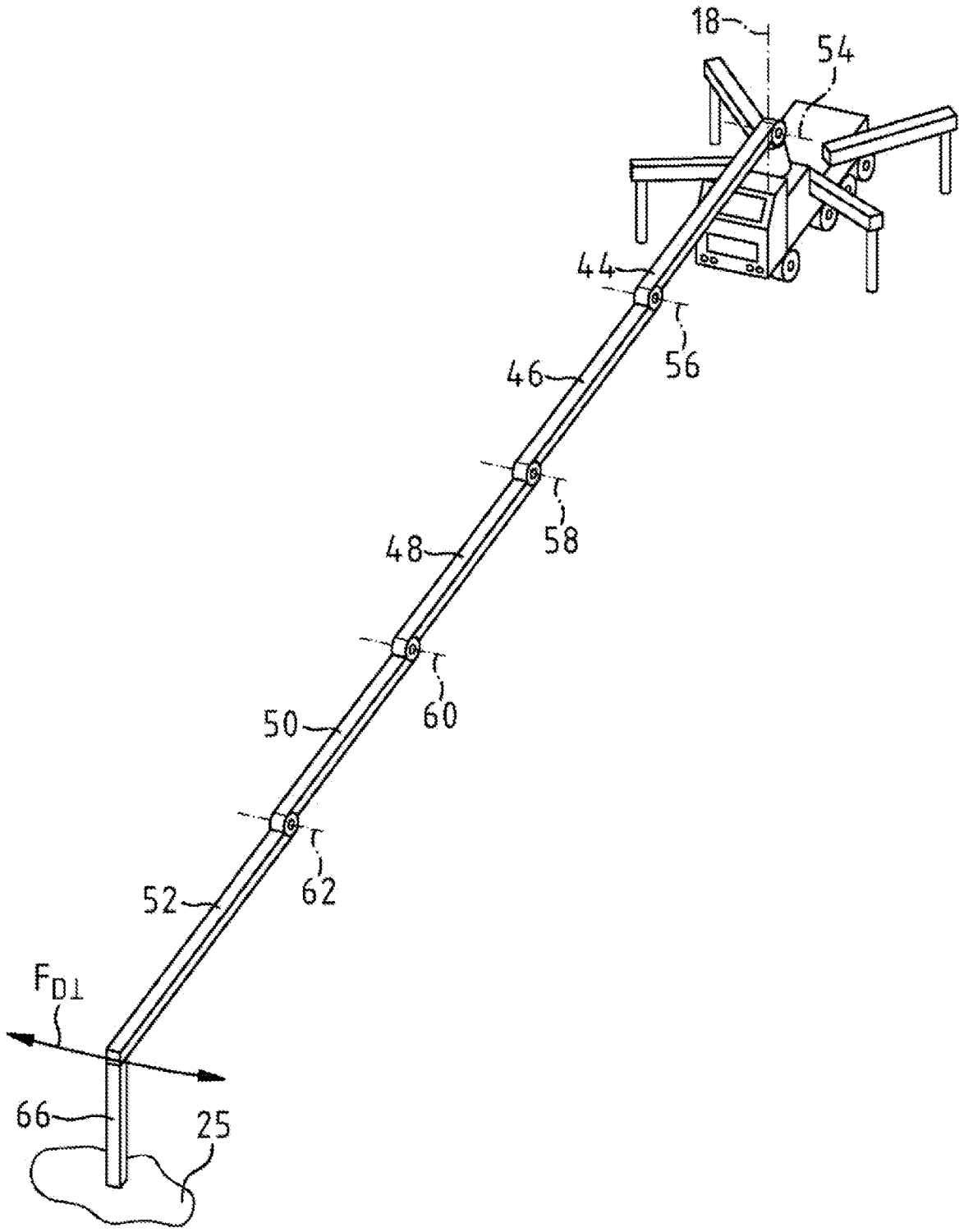

FIG. 1 shows a large manipulator in a truck-mounted concrete pump 10. The truck-mounted concrete pump 10 comprises a transport vehicle 12 and includes a pulsating thick matter pump 14 designed, for example, as a two-cylinder piston pump. In the truck-mounted concrete pump 10, the large manipulator is mounted on a frame 16 that is fixed to the vehicle. The large manipulator comprises a distributor boom 20 that is rotatable, at a swivel joint 28, about a vertical axis 18 fixed to the vehicle. This distributor boom 20 supports a concrete delivery line 22. As can be seen in FIG. 2 and FIG. 3, liquid concrete, which is continuously introduced into a feed container 24 during concreting, can be conveyed to a concreting point 25 located so as to be remote from the location of the vehicle 12, via the delivery line 22.

It should be noted that the large manipulator is, in principle, not only arranged on a transport vehicle, on a frame fixed to the vehicle, but can rather also be arranged on a frame having a fixed location, e.g., arranged on a construction site. In this case, the concrete delivery line received on the distributor boom of the large manipulator is connected to a preferably mobile concrete pump.

The distributor boom 20 comprises a rotatable boom pedestal 30, which can be rotated by means of a drive unit 26, which is designed as a hydraulic rotary drive, about the vertical axis 18 of the articulating joint 28, which axis forms a rotation axis. The distributor boom 20 includes an articulated boom 32 which can be pivoted on the boom pedestal 30 and which can be continuously adjusted to a variable range and height difference between the vehicle 12 and the concreting point 25. In the embodiment shown, the articulated boom 32 has five boom arms 44, 46, 48, 50, 52 articulated to one another by articulated joints 34, 36, 38, 40, 42, which boom arms are pivotable about articulation axes 54, 56, 58, 60, 62 which are arranged so as to be mutually parallel and at right angles to the vertical axis 18 of the boom pedestal 30.

For moving the boom arms about the articulation axes 54, 56, 58, 60, and 62 of the articulated joints 34, 36, 38, 40, 42, the large manipulator has drive units, e.g., hydraulic drives, 68, 78, 80, 82, and 84 associated with the articulated joints.

The arrangement about the articulation axes 54, 56, 58, 60, 62, of the articulated joints 34, 36, 38, 40, 42 and the articulation angles $\varepsilon_i$, i=34, 36, 38, 40, 42 (FIG. 2) which can be adjusted, in the case of the distributor boom, by adjusting the articulated joints, makes it possible for the distributor boom 20 to be stored on the vehicle 12 by means of the space-saving transport configuration, corresponding to a multiple folding process, as visible in FIG. 1.

The articulated boom 32 comprises a boom tip 64 on which an end hose 66 is arranged, through which liquid concrete can be discharged from the delivery line 22 of the distributor boom 20 to the concreting point 25.

The large manipulator of the truck-mounted concrete pump 10, together with the transport vehicle 12, forms a vibratory system that can be excited to forced vibrations by the pulsating thick matter pump 14 during operation. These vibrations can lead to deflections of the boom tip 64 and the end hose 66 hanging thereon at vibration amplitudes of up to one meter or even more, the frequencies of these vibrations being between 0.5 Hz and several Hz.

The large manipulator of the truck-mounted concrete pump 10 includes a control device with a mechanism that actively dampens such vibrations by generating additional forces or additional torques by the drive units 26, 68, 78, 80, 82, 84 in the large manipulator. These additional forces or additional torques produce a damping force acting on the distributor boom 20. This damping force is preferably a damping force $F_D\perp$ that acts, for example, perpendicularly on the boom tip 64 and in the horizontal direction, by means of which the rotatory vibrations of the distributor boom 20 about the axis of rotation 18 are weakened (see FIG. 3), and/or a damping force $F_{D\|}$ which acts on the articulated boom 32 of the distributor boom 20 in the vertical direction (see FIG. 2), by means of which the vibrations of the distributor boom 20 in the plane defined by the axis of rotation 18 and the boom tip 64 are weakened.

It should be noted, however, that, in a modified embodiment of the large manipulator of the truck-mounted concrete pump 10, it may also be possible for the additional forces or additional torques generated to lead to a damping force that acts on the distributor boom 20 in accordance with a point at a distance from the boom tip 64, e.g., on the first, second, third, or fourth boom arm 44, 46, 48, 50, preferably in the area of the articulated joints 36, 38, 40 or 42. Furthermore, it is possible for several additional forces and/or additional torques to be generated in the distributor boom 20 by means of the drive units 26, 68, 78, 80, 82, 84, which act on said boom at the same time in order to dampen it.

Figure 4:
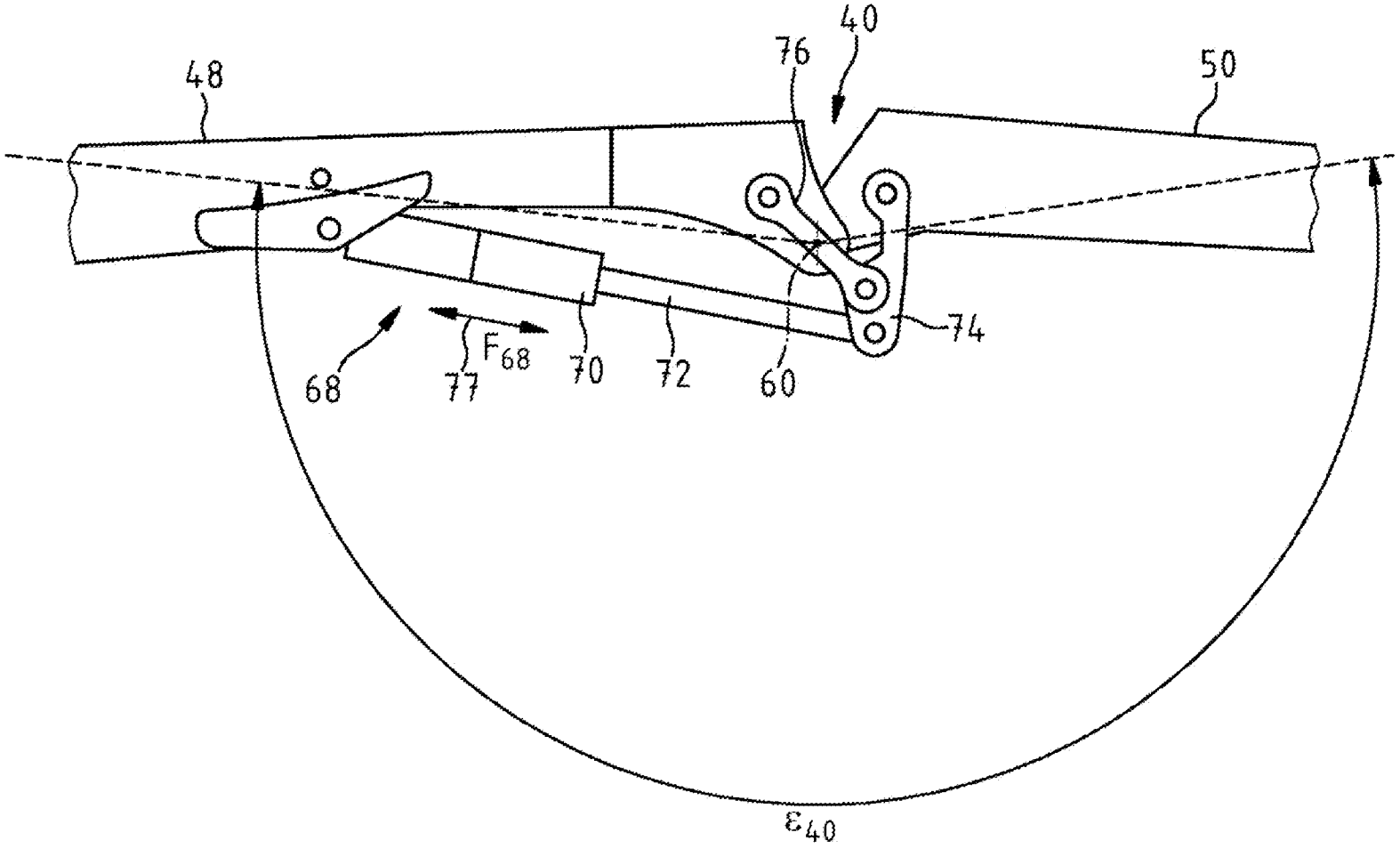
FIG. 4 is a view of an articulated joint with a drive unit in the distributor boom of the large manipulator.

FIG. 4 shows the articulating joint 40 with a section of the boom arm 48 and a section of the boom arm 50. In order to move the boom arm 48 relative to the boom arm 50 about the articulating axis 60 of the articulated joint 38, the distributor boom 20 has a drive unit 68 designed as a hydraulic cylinder, the cylinder part 70 of which is connected to the boom arm 48, and the cylinder rod 72 of which acts on a lever element 74 that is articulated with respect to the boom arm 50 and is connected to the boom arm 48 in an articulated manner by means of a guide element 76.

In this case, the drive unit 68 generates an actual force $F_i$, i=68, acting in the direction of the double arrow 77, which is transmitted to the lever element 74 and, owing to the guide element 76 connected to the lever element 74, brings about an actual torque $M_i$, i=60, around the articulating axis 60 of the articulated joint 40, introduced as a torque from the boom arm 48 into the boom arm 50.

Figure 5:
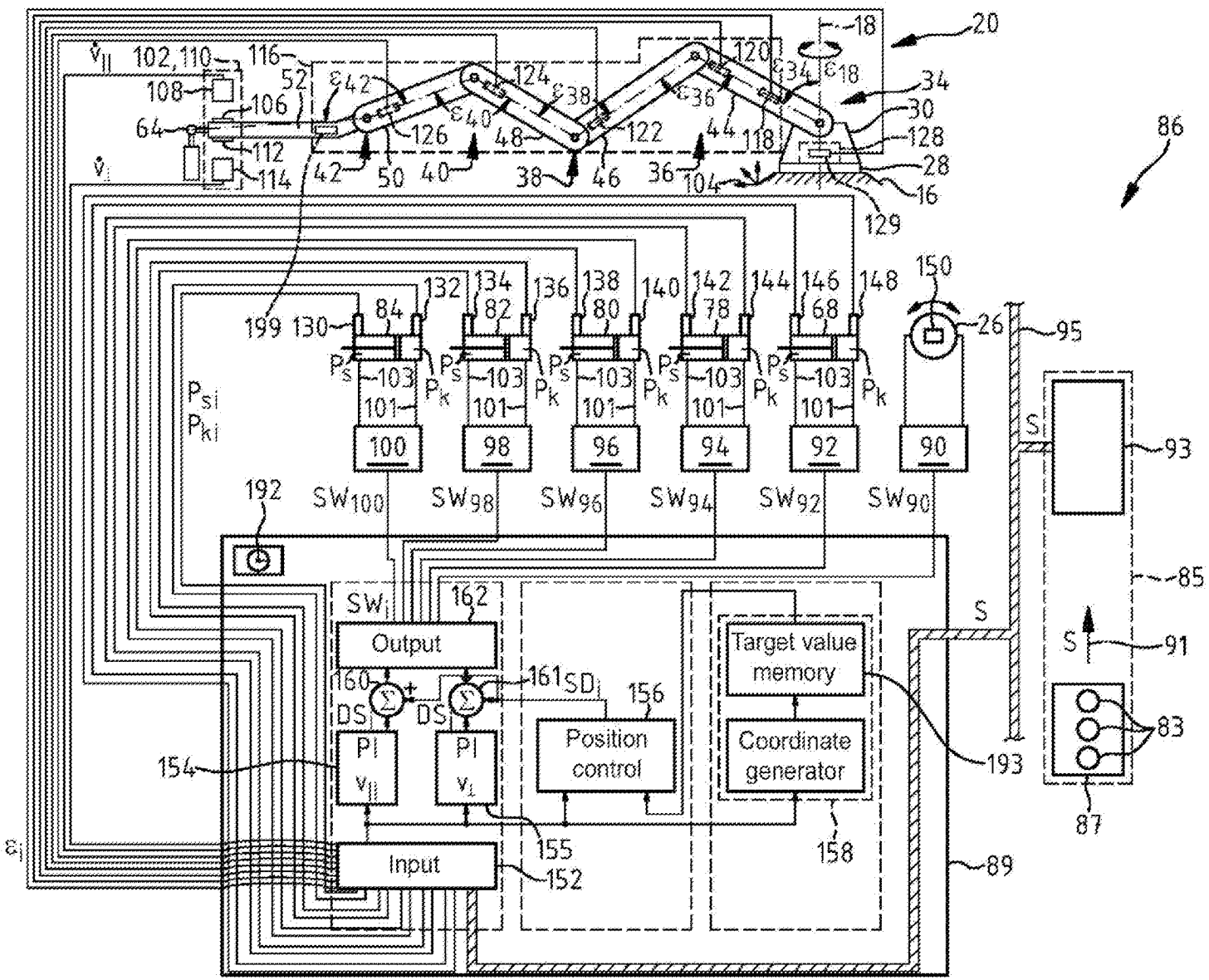
FIG. 5 is a diagram of a first control device for controlling the movement of the distributor boom having a controller assembly.

In order to control the movement of the boom arms of the articulated boom 32, the large manipulator has a control device 86, which is explained below with reference to FIG. 5. The control device 86 controls the movement of the articulated boom 32 with the aid of actuating elements 90, 92, 94, 96, 98, 100 for the drive units 26, 68, 78, 80, 82, and 84 associated with the articulated joints 34, 36, 38, 40, 42 and the articulating joint 28.

As a result of the program-controlled activation of the drive units 26, 68, 78, 80, 82, and 84 which are associated, individually, with the articulating axes 54, 56, 58, 60, and 62 and the axis of rotation 18, the articulated boom 32 can be unfolded at different distances and/or height differences between the concreting point 25 and the vehicle location (see, e.g., FIG. 2 and FIG. 3).

The boom operator controls the distributor boom 20 by, means of, e.g., a control assembly 85 comprising a controller 87. The controller 87 is designed as a remote control and includes operating elements 83 for adjusting the distributor boom 20 with the articulated boom 32, which remote control generates control signals S which can be fed to a controller assembly 89.

The control signals S are transmitted via a radio link 91 to a vehicle-mounted radio receiver 93 which is connected, on the output side, to the controller assembly 89 by means of a bus system 95 that is designed, for example, as a CAN bus.

The control device 86 includes a device 102 for determining the boom tip vertical speed $v_{||}$ in a coordinate system 104 referenced to the frame 16 in a plane parallel with the articulated boom 32, and defined by the axis of rotation 18 and the boom tip 64. The device 102 for determining the boom tip vertical speed $v_{||}$ has an acceleration sensor 106 arranged on the boom arm 52, which sensor is combined with an evaluation stage circuitry 108. By means of integration over time, the boom tip vertical speed $v_{||}$ in the (usually vertical) plane in parallel with the articulated boom 32, in which the axis of rotation 18 of the boom pedestal 30 and the boom tip 64 are located, is determined in the controller assembly 89 based on the signal $v'_{||}$ from the acceleration sensor 106.

In addition, the control device 86 includes a device 110 for determining the boom tip horizontal speed $v\perp$ in the plane perpendicular to the axis of rotation 18 of the boom pedestal 30, in which the boom tip 64 is located. The device 110 for determining the boom tip horizontal speed $v\perp$ has an acceleration sensor 112 which is arranged on the boom arm 52 and is combined with an evaluation stage circuitry 114. Based on the signal $v'_{\perp}$ from the acceleration sensor 112, the boom tip speed $v\perp$ in the (usually horizontal) plane perpendicular to the axis of rotation 18 of the boom pedestal 30 is determined in the controller assembly 89.

In a further, alternative embodiment of the large manipulator, it may be possible for the controller assembly 89 to receive the speed of a portion of a boom arm determined by a device for determining the speed of a boom arm location of a boom arm, e.g., the speed of the boom tip, without this having to be calculated in the controller assembly 89.

The control device 86 also includes a device 116 for determining the articulating angles $\varepsilon_i$, i=34, 36, 38, 40, 42 of the articulated joints 34, 36, 38, 40, 42 comprising angle sensors 118, 120, 122, 124, 126, and 199 and a device 128 for determining the angle of rotation $\varepsilon_i$, i=18 about the vertical axis 18 of the articulating joint 28 by means of an angle sensor 129.

In this context, it should be noted that, in a further alternative embodiment of the large manipulator, it may be possible for the controller assembly 89 to include a device for determining the boom tip vertical speed $v_{||}$, in which the boom tip speed is calculated (forward transformation) based on the evolution over time of the articulating angles ε, i=34, 36, 38, 40, 42 of the articulated joints 34, 36, 38, 40, 42 of the articulated boom 32 and the geometry thereof.

The control device 86 includes pressure sensors 130, 132, 134, 136, 138, 140, 142, 144, 146, 148, which are associated with the drive units 26, 68, 78, 80, 82 and 84 designed as hydraulic cylinders. These pressure sensors are used to measure the rod-side pressure $p_{Si}$, i=130, 134, 138, 142, 146, and the piston-side pressure $p_{Ki}$ i=132, 136, 140, 144, 148, of the hydraulic oil. The pressure sensors 130, 132, 134, 136, 138, 140, 142, 144, 146, 148 enable the determination of the actual force $F_i$, i=68, 78, 80, 82, 84, which is generated by means of the drive units 68, 78, 80, 82 and 84, and is generated and introduced into the boom arms 44, 46, 48, 50, 52 of the articulated boom 32.

Regarding the drive unit 26 designed as a hydraulic rotary drive, the control device 86 comprises a torque sensor 150 which is designed to detect the actual torque $M_i$, i=18, introduced into the boom pedestal 30 as a torque by means of the rotary drive.

The controller assembly 89 is used to control the actuating elements 90, 92, 94, 96, 98, 100 of the drive units 26, 68, 78, 80, 82 and 84. The actuating elements 90, 92, 94, 96, 98, 100 are designed as proportional shuttle valves, the output lines 101, 103 of which are connected, on the bottom and on the rod side, to the drive units 68, 78, 80, 82, and 84 designed as double-acting hydraulic cylinders, or as hydraulic motors.

The controller assembly 89 generates control signals $SW_i$, i=90, 92, 94, 96, 98, and 100 for the actuating elements of the drive units of the distributor boom 20 based on the control signals S from the control assembly 85. By means of controlling the actuating elements 90, 92, 94, 96, 98, 100, the postures of the distributor boom 20 are adjusted to target values $W_{target}$ that can be specified by the control assembly 85, by evaluating the position of the articulating angles $\varepsilon_i$, i=34, 36, 38, 40, 42 of the articulated joints 34, 36, 38, 40, 42, detected by the angle sensors 118, 120, 122, 124 and 126, by means of the angle sensors 118, 120, 122, 124 and 126, and of the angle of rotation $\varepsilon_i$, i=18 of the boom pedestal 30 about the axis of rotation 18, detected by the angle sensor 129.

In this case, the controller assembly 89 superimposes positioning control variables $SD_i$, i=90, 92, 94, 96, 98, 100 for the actuating elements 90, 92, 94, 96, 98, 100, which regulate the postures of the distributor boom 20 to the target values $W_{target}$, additional damping control variables $DS_i$, i=90, 92, 94, 96, 98, 100, with which undesired vibrations of the boom tip 64 of the articulated boom 32 in the distributor boom 20 are counteracted.

The controller assembly 89 has circuitry for an input routine 152, by means of which the device 102 for determining the boom tip vertical speed $v_{||}$, the device 110 for determining the boom tip horizontal speed $v\perp$ in a plane perpendicular to the axis of rotation 18 of the boom pedestal 30, and the device 116 for determining the articulating angle $\varepsilon_i$, i=18 of the articulated joints 34, 36, 38, 40, 42 by means of the angle sensors 118, 120, 122, 124 and 126, and the device 128 for determining the angle of rotation $\varepsilon_i$, i=18 about the vertical axis 18 of the articulating joint 28 is continuously queried by means of the angle sensor 129. The input routine 152 also continuously receives the signals $p_{Si}$, $p_{Ki}$ from the pressure sensors 130, 132, 134, 136, 138, 140, 142, 144, 146, 148. The control signals S are also read from the control assembly 85 by means of the input routine 152.

The controller assembly 89 includes circuitry for a first distributor boom damping routine 154 and a further distributor boom damping routine 155 parallel thereto. The distributor boom damping routine 154 determines, based on a boom tip speed determined by the device 102 for determining the boom tip speed $v_{||}$ in the plane in parallel to the articulated boom 32, a target damping force $$F_{D||}=v_{||}D_{||},$$

in which $D_{\|}$ is an appropriately selected damping constant. The distributor boom damping routine 154 then divides the target damping force $F_D$ determined in this way into several component target damping forces $F_{Di}$, i=34, 36, 38, 40, 42, which are associated with the individual articulated joints 34, 36, 38, 40, 42:

$$F_D = \sum_i n_i F_{Di},$$

the factors $n_i$ being parameters selected in a device-specific manner that meet the following boundary conditions:

$$\sum_i n_i = 1$$

Then, for each actuating element 92, 94, 96, 98, and 100, a damping control variable $DS_i$, i=92, 94, 96, 98, 100 is determined based on the component target damping forces $F_{Di}$, i=34, 36, 38, 40, 42 and the articulating angles $\varepsilon_i$, i=34, 36, 38, 40, 42, determined by means of the device 116 for determining the articulating angles of the articulated joints 34, 36, 38, 40, 42, for the drive units that are associated with the articulated joints 34, 36, 38, 40, 42, for damping the distributor boom 20.

In the further distributor boom damping routine 155 of the controller assembly 89, a target damping torque $M_D\perp=v\perp D\perp$ is determined by the device 110 based the boom tip horizontal speed $v\perp$ in the plane perpendicular to the axis of rotation 18 of the boom pedestal 30. In this case, the variable $D\perp$ is again an appropriately selected damping constant.

Then, a damping control variable $SD_{90}$ is determined for the actuating element 90 based on the target damping torque $M_D\perp$ and the angle of rotation $\varepsilon_i$, i=18 determined for the drive unit 26 associated with the boom pedestal 30 by means of the device 128 for determining the angle of rotation of the boom pedestal 30 about the axis of rotation 18 thereof.

The controller assembly 89 includes circuitry for an output routine 162 which outputs control signals $SW_i$, i=90, 92, 94, 96, 98, 100 to the actuating elements 90, 92, 94, 96, 98, and 100.

The controller assembly 89 includes circuitry for a distributor boom control routine 156 and a distributor boom target posture value routine 158. The distributor boom target posture value routine 158 receives the control signals S of the controller 87 from the input routine 152 and translates these into target posture values $PS_i$ in the form of target values for the articulating angles $\varepsilon_i$, i=34, 36, 38, 40, 42 of the articulated joints 34, 36, 38, 40, 42 and the angle of rotation $\varepsilon_{18}$ of the boom pedestal 30 about the vertical axis 18.

The distributor boom control routine 156 receives actual posture values $PI_i$, in the form of actual values of the angles $\varepsilon_i$ detected by the angle sensors 118, 120, 122, 124, 126, 129, from the input routine 152. Using a control loop implemented in the distributor boom control routine 156, the positioning control variables $SD_i$, i=90, 92, 94, 96, 98, 100 for the actuating elements 90, 92, 94, 96, 98, and 100 of the drive units 26, 68 78, 80, 82, 84 are determined in the controller assembly 89 based on the actual posture values $PI_i$ and the target posture values $PS_i$.

In circuitry for a superimposition routine 160, the damping control variables $DS_i$, i=92, 94, 96, 98, 100 are added to the positioning control variables $SD_i$, i=92, 94, 96, 98, 100 and fed to circuitry for an output routine 162. This sends corresponding control signals $SW_i$, i=92, 94, 96, 98, 100, which are generated as control signals $SW_i=DS_i+SD_i$ based on the positioning control variables $SD_i$ and damping control variables $DS_i$, i=92, 94, 96, 98, 100, to the actuating elements 92, 94, 96, 98 and 100.

Correspondingly, in circuitry for a superimposition routine 161, the damping signal $DS_{90}$ is added to the positioning control variable $SD_{90}$ and fed to the output routine 162, which transfers the corresponding sum signal $SW_{90}=DS_{90}+SD_{90}$ to the actuating element 90 as an actuating signal $SW_{90}$.

Figure 6:
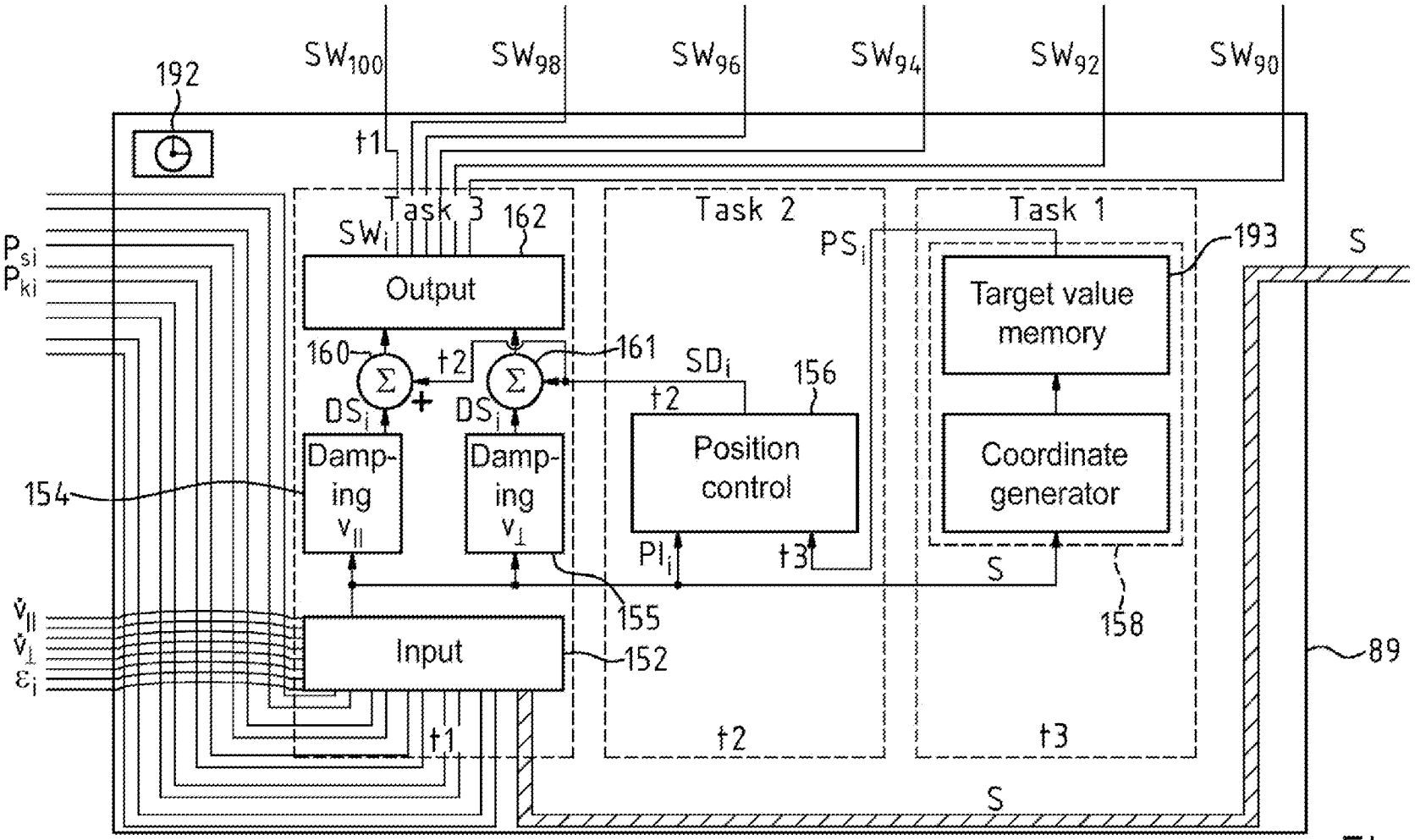
FIG. 6 is diagram depicting the coordination of the target value generation for distributor boom postures, the regulation of these postures, and the active damping of vibrations of the distributor boom with control signals generated in the controller assembly.

FIG. 6 shows the controller assembly 89 with the processor clock 192. By means of the input routine 152, in the controller assembly 89, the angles of the joints of the distributor boom 20 detected by means of the angle sensors 118, 120, 122, 124, 126 and 129 of the devices 116, 128, the signals of the devices 102, 110 are detected by means of the acceleration sensors 106, 112, the signals of the pressure sensors 130, 132, 134, 136, 138, 140, 142, 144, 146, 148 and of the torque sensor 150, and the control signal S of the control assembly 85 are detected at regular time intervals $\Delta t_S$ specified by the processor clock 192.

The signals of the angle sensors supplied to the input routine 152 are fed to the distributor boom control routine 156 in the controller assembly 89 as actual posture values $PI_i$, i=18, 34, 36, 38, 40, 42. The control signal S transmitted to the input routine 152 by the control assembly 85 outputs this to the distributor boom target posture routine 158.

Said signal thus determines target posture values $PS_i$, i=18, 34, 36, 38, 40, 42 in the form of settings of the articulating angles $\varepsilon_i$, i=34, 36, 38, 40, 42 of the articulated joints and the angle of rotation $\varepsilon_{18}$ of the swivel joint 28. The target posture values $PS_i$ are stored in the target posture value routine 158, in a target value memory 193. From this target value memory 193, the target posture values $PS_i$ are continuously fed to the distributor boom control routine 156.

Figure 7:
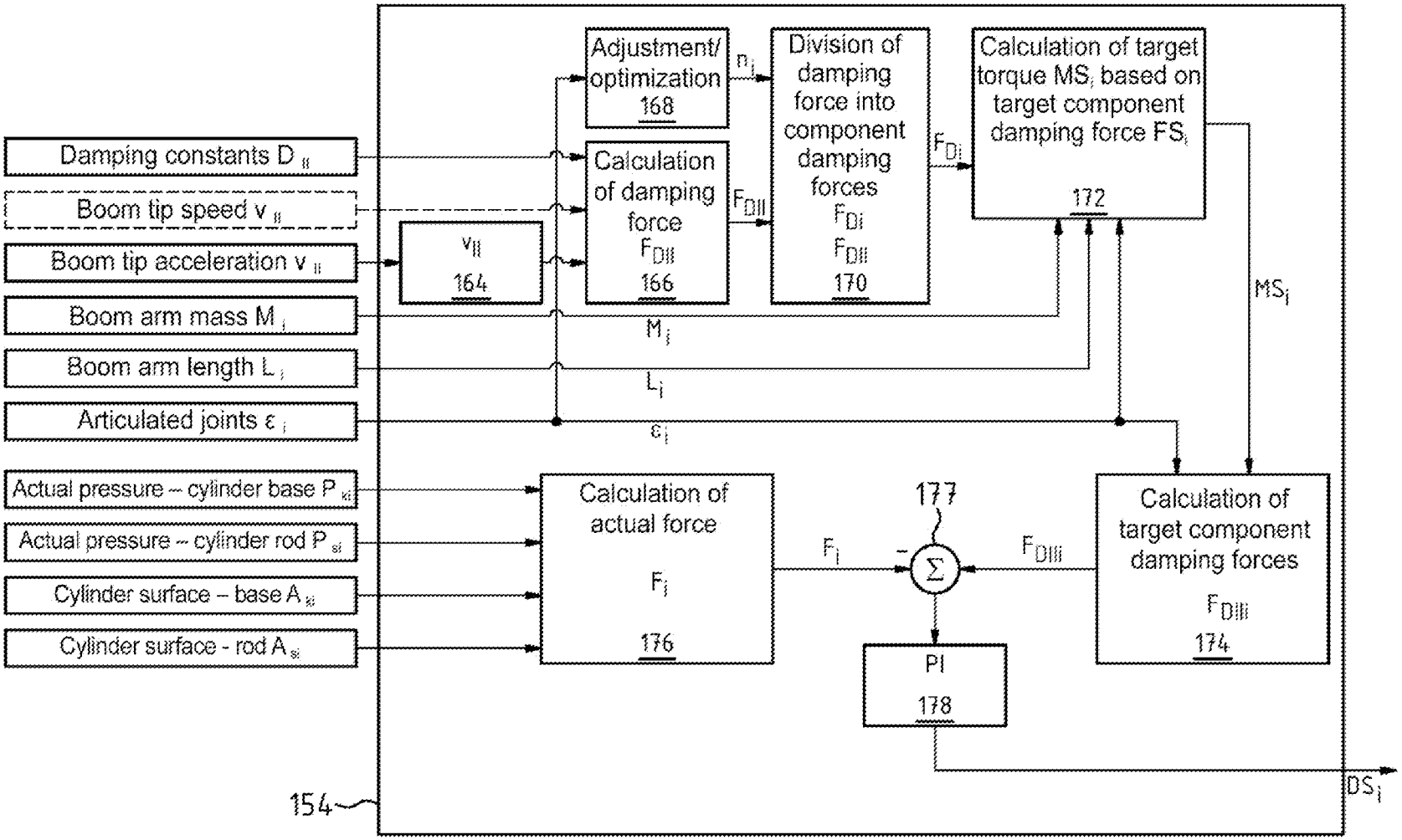
FIG. 7 is a schematic depiction of a first distributor boom damping routine in the controller assembly.

FIG. 7 is a block diagram of the first placing boom damping routine 154 in the controller assembly 89 in the form of a block diagram. The distributor boom damping routine 154 includes a calculation stage 164 for calculating the boom tip vertical speed $v_{\|}$, in the plane in parallel with the axis of rotation 18 of the distributor boom 20 and its articulated boom 32, based on the signal from the device 102. In a damping force calculation stage 166, the damping force $F_{D\|}$ is calculated on the basis of an empirically determined damping constant $D_{\|}$ that is supplied to the distributor boom damping routine 154. The damping force $F_{D\|}$ calculated is then separated into a linear combination $F_{D\|}=\Sigma_i n_i F_{D\|}$, i=34, 36, 38, 40, 42 of individual component target damping forces $F_{D\|i}$, for a separation stage 170, by means of a separation algorithm which is continuously optimized in an optimization stage 168 designed as an adjustment stage, the following applying:

$$\sum_i n_i = 1$$

Based on the physical variables known for the distributor boom 20, i.e., the mass $m_i$, i=44, 46, 48, 50, 52 and the length $l_i$, i=44, 46, 48, 50, 52 of the boom arms 44, 46, 48, 50, 52 and the articulating angles $\varepsilon_i$, i=34, 36, 38, 40, 42 of the articulated joints 34, 36, 38, 40, 42, the target torques $MS_i$, i=54, 56, 58, 60, 62 to be generated by means of the drive units 68, 78, 80, 82 and 84, in the joint axes 54, 56, 58, 60, 62 of the articulated joints 34, 36, 38, 40, 42 are then generated in an axial torque calculation stage 172. The adjustment forces of the drive units 68, 78, 80, 82 and 84 that are required for generating the target torques $MS_i$ are then determined, in circuitry for a calculation stage 174, as the component target damping forces $F_{D\|i}$, i=34, 36, 38, 40, 42 to be generated by means of the drive units 68, 78, 80, 82 and 84, in the joint axes 54, 56, 58, 60, 62 of the articulated joints 34, 36, 38, 40, 42.

The distributor boom damping routine 154 includes, as a device 176 for determining the actual force $F_i$ which is generated by means of the drive unit 78, 80, 82, 84 associated with the joint 34, 36, 38, 40, 42, circuitry for a force calculation routine which includes the signals of the pressure sensors 130, 132, 134, 136, 138, 140, 142, 144, 146, 148 associated with the drive units 68, 78, 80, 82 and 84, in order to thereby determine, on the basis of the geometric dimensions of the hydraulic cylinders of the drive units 68, 78, 80, 82 and 84, the generated actual force $F_i$, i=68, 78, 80, 82, 84 which is introduced into the boom arms 44, 46, 48, 50, 52.

The distributor boom damping routine 154 also includes a control stage 178 to which, as a controlled variable, the difference determined in a difference routine 177 between the actual force $F_i$, i=68, 78, 80, 82, 84 generated in each case by the drive units 68, 78, 80, 82 and 84 and the corresponding target component damping force $F_{D\|i}$, i=34, 36, 38, 40, 42, in order to thereby generate a damping control variable $DS_i$, i=92, 94, 96, 98, 100 for the actuating element 92, 94, 96, 98, 100 associated with the drive units 68, 70, 80, 82, 84 in each case, which control variable is output at the superimposition routine 160 shown in FIG. 6.

Figure 8:
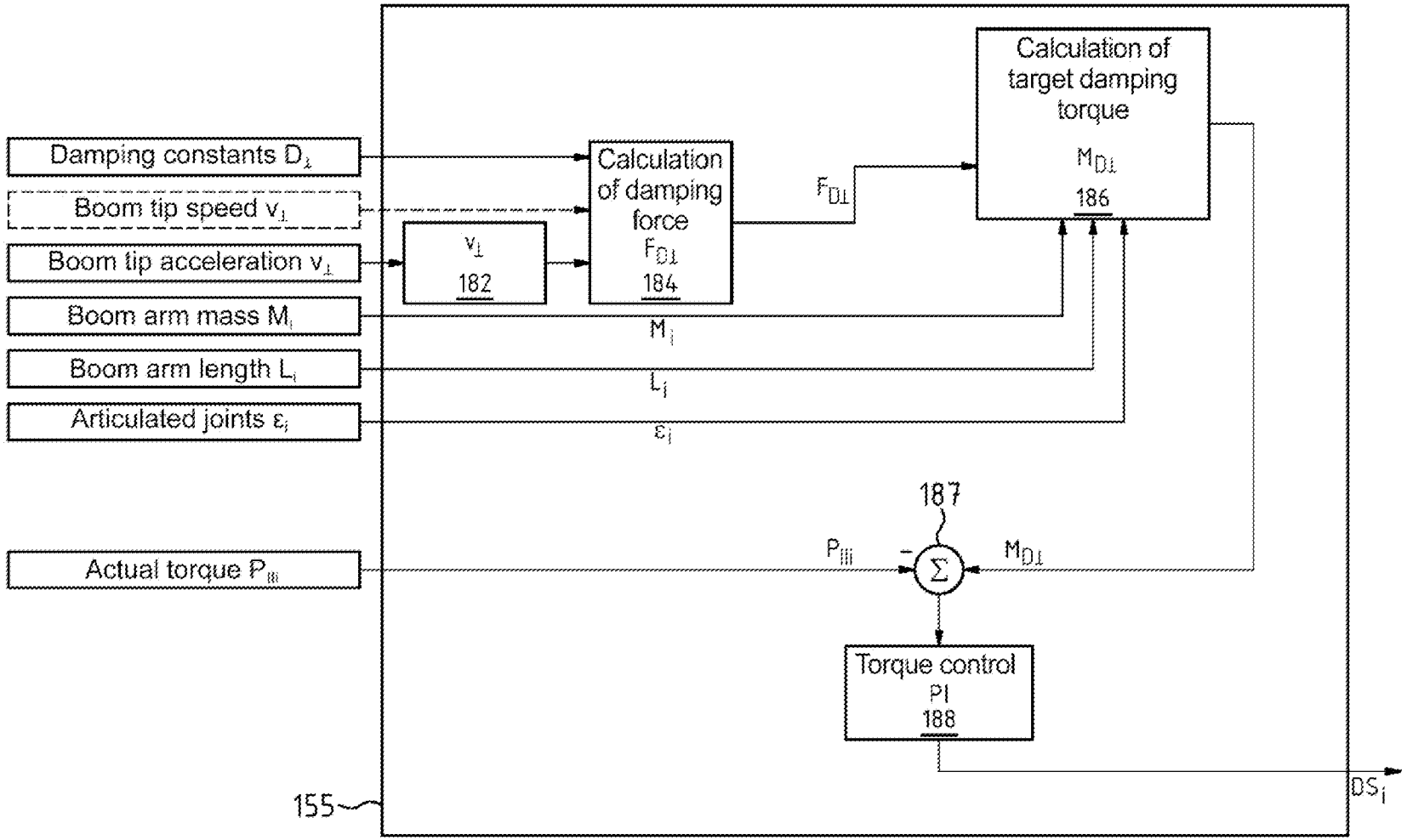
FIG. 8 is a schematic depiction of another distributor boom damping routine in the controller assembly.

FIG. 8 is a block diagram of the further distributor boom damping routine 155 in the controller assembly 89. The distributor boom damping routine 155 has a calculation stage 182 for calculating the boom tip horizontal speed v⊥ in the plane perpendicular to the axis of rotation 18 of the distributor boom 20 in which the boom tip 64 is arranged. In a damping force calculation stage 184, the damping force $F_D\perp$ is calculated on the basis of an empirically determined damping constant D⊥ supplied to the distributor boom damping routine 155.

Based on the physical variables known for the distributor boom 20, i.e., the mass $m_i$ and length $l_i$, i=44, 46, 48, 50, 52 of the boom arms 44, 46, 48, 50, 52, and the articulating angles $\varepsilon_i$, i=34, 36, 38, 40, 42 of the articulated joints, the target damping torque $M_D\perp_{26}$ to be generated by the drive unit 26 is then calculated in a torque calculation stage 186.

The distributor boom damping routine 155 includes a torque control stage 188 which is supplied, as a controlled variable, the difference determined in a difference routine 187 between the actual torque $MI_i$, i=26 generated by means of the drive unit 26, about the axis of rotation 18 and the corresponding target torque $M_D\perp_{26}$, in order to thereby generate a damping control variable $DS_i$, i=90 for the actuating element 90 of the drive unit 26, which control variable is ultimately output to the superimposition routine 161.

Figure 9:
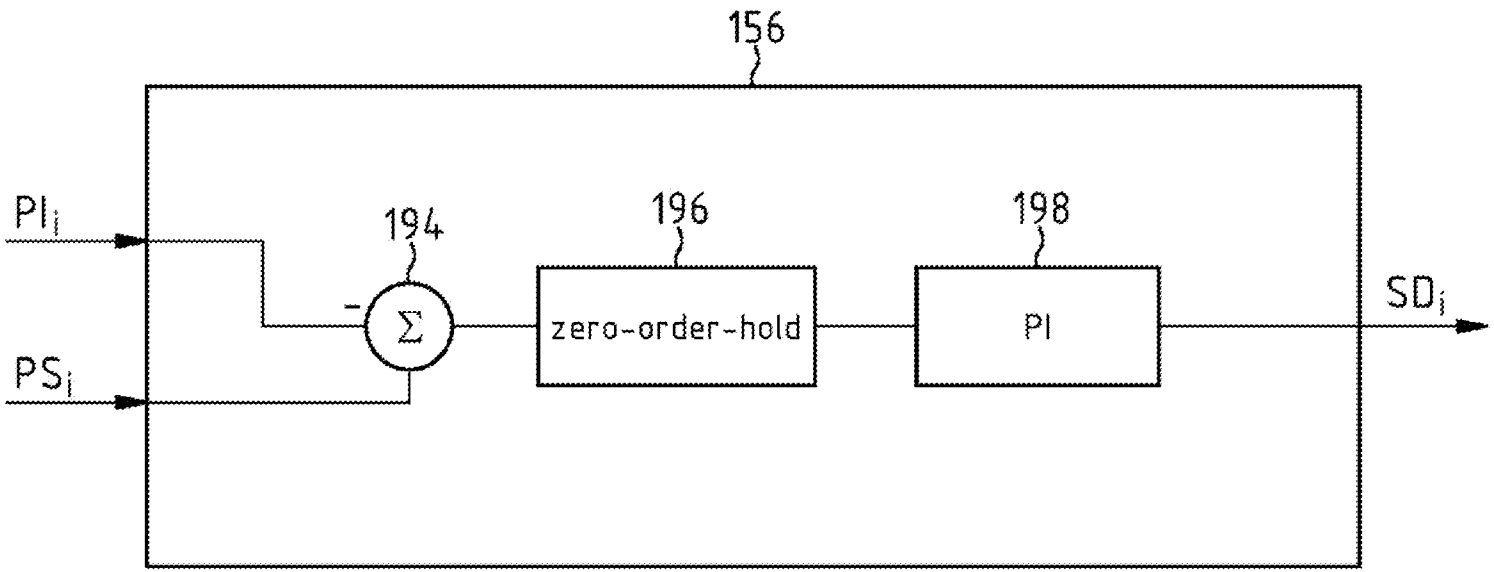
FIG. 9 is a schematic depiction of a distributor boom control routine in the controller assembly.

FIG. 9 is a block diagram of the distributor boom control routine 156 in the controller assembly 89.

The distributor boom control routine 156 includes a difference routine 194 which feeds the difference between the actual posture values $PI_i$ and the target posture values $PS_i$ to a zero order hold filter 196, which discretizes this difference by multiplying it with a sampling function and uses it as a control variable of a control stage 198 designed as a PI regulator which outputs the positioning control variable $SD_i$.

The effect of the zero order hold filter 196 is that, only when the deviation of an actual posture value $PI_i$ from a target posture value $PS_i$ exceeds a threshold value, the control stage 198 receives a controlled variable different from the value zero, and only then receives a corresponding positioning control variable $SD_i$ for the posture correction. In contrast, the distributor boom damping routine 154, 155 regulates the damping force $F_{D\|}$ or $F_D\perp$ for damping boom vibrations by continuously providing the damping control variables $DS_i$.

The positioning control variable $SD_i$ generated by the distributor boom control routine 156 based on the target posture values $PS_i$ and the actual posture values $PI_i$ are combined, in the superimposition routines 160 and 161, with the damping control variables $DS_i$ from the distributor boom damping routines 154, 155, and then supplied, as the control signal $SW_i$, to the output routine 162 which supplies each of the actuating elements 90, 92, 94, 96, 98, 100 with the corresponding control signal $SW_i$. In this case, the superimposition routines 160 and 161 are designed as adding routines which add the damping control variables $DS_i$ to the actuation signals.

The distributor boom damping routines 154, 155, the distributor boom control routine 156, and the distributor boom target posture value routine 158 work in step with the processor clock 192 and are called up in the controller assembly 89. In this case, the distributor boom target posture value routine 158 takes place at times t3 only after the distributor boom damping routines 154, 155 have been called up several times, the distributor boom damping routines 154, 155 being called up, in this case, at times t1<<t3. The distributor boom control routine 156 called up at times t2, only after the distributor boom damping routines 154, 155 have been called up several times, but between two distributor boom target posture value routines 158. In this case, the following applies: t1<<t2<<t3.

Figure 10:
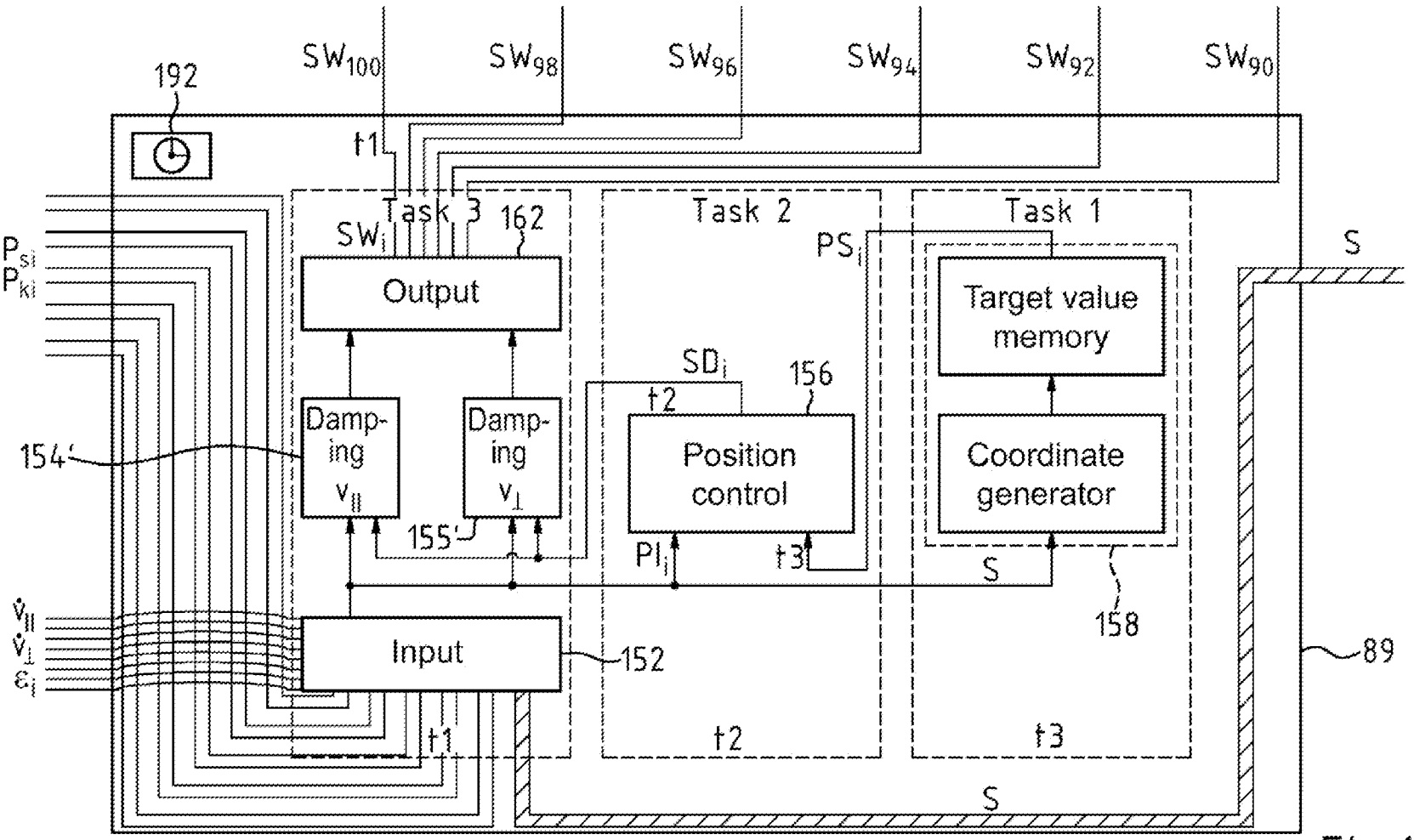
FIG. 10 is a schematic depiction of the coordination of the target value generation for distributor boom postures, the regulation of these postures, and the active damping of vibrations of the distributor boom with control signals generated in an alternative controller assembly.

FIG. 10 shows a controller assembly 89' for use in the control device 86. Insofar as the assemblies and elements for coordinating the target value generation for distributor boom postures, the control of which postures and the active damping of vibrations of the distributor boom by means of control signals are generated in the controller assembly 89', correspond to the assemblies and elements for coordinating the target value generation for distributor boom postures, the control of these postures, and the active damping of vibrations of the distributor boom with control signals generated in the controller assembly 89, said assemblies and elements are denoted by the same numbers as reference signs.

In contrast to the controller assembly 89, the controller integration is implemented in a serial structure in the controller assembly 89'. For this purpose, the controller assembly 89' again includes a first distributor boom damping routine 154' and a further distributor boom damping routine 155' in parallel therewith for generating control signals $SW_i$, i=90, 92, 94, 96, 98, 100, which are output to the actuating elements 90, 92, 94, 96, 98 and 100 by means of the output routine 162.

Figure 11:
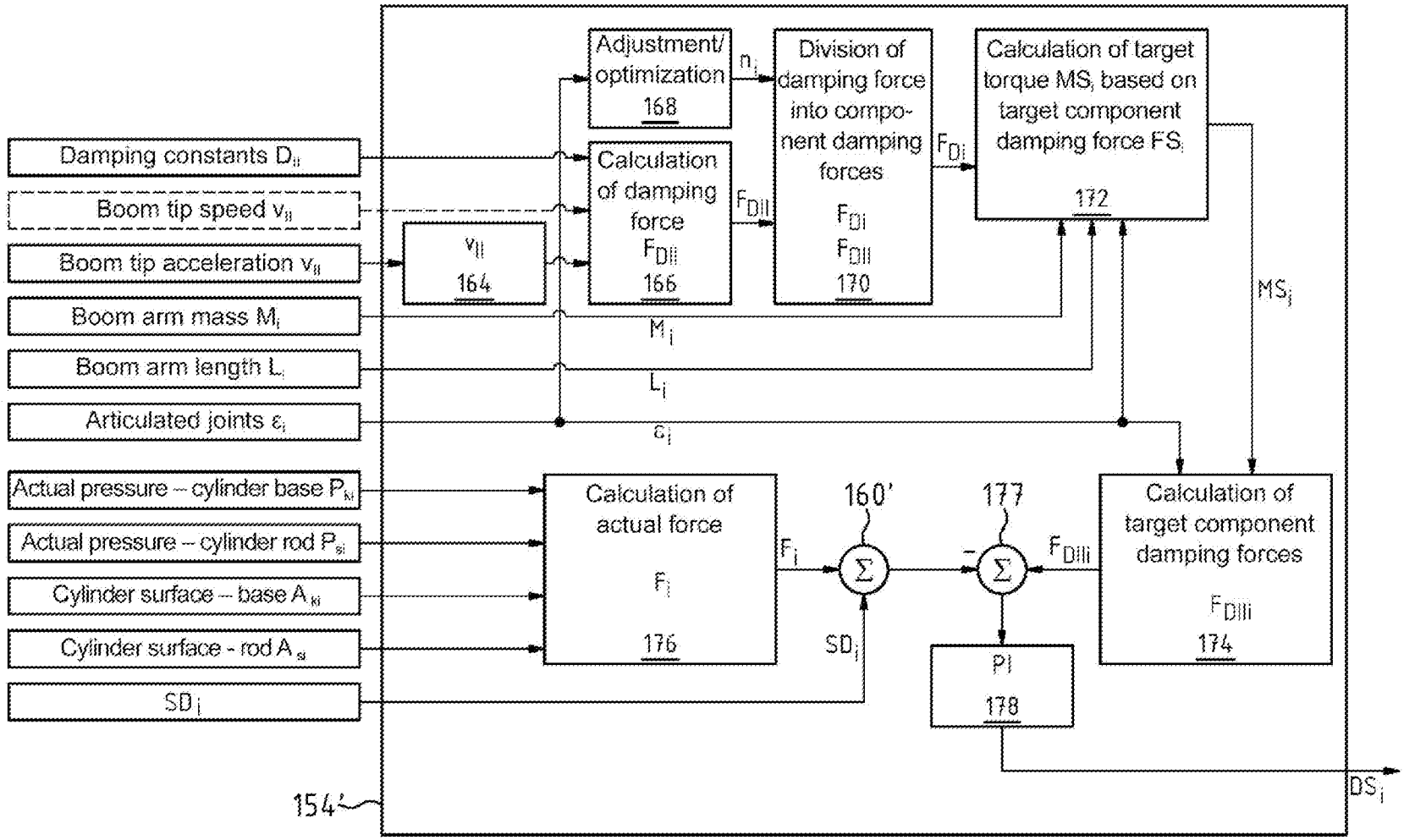
FIG. 11 is schematic depiction of a first distributor boom damping routine in the controller assembly.
Figure 12:
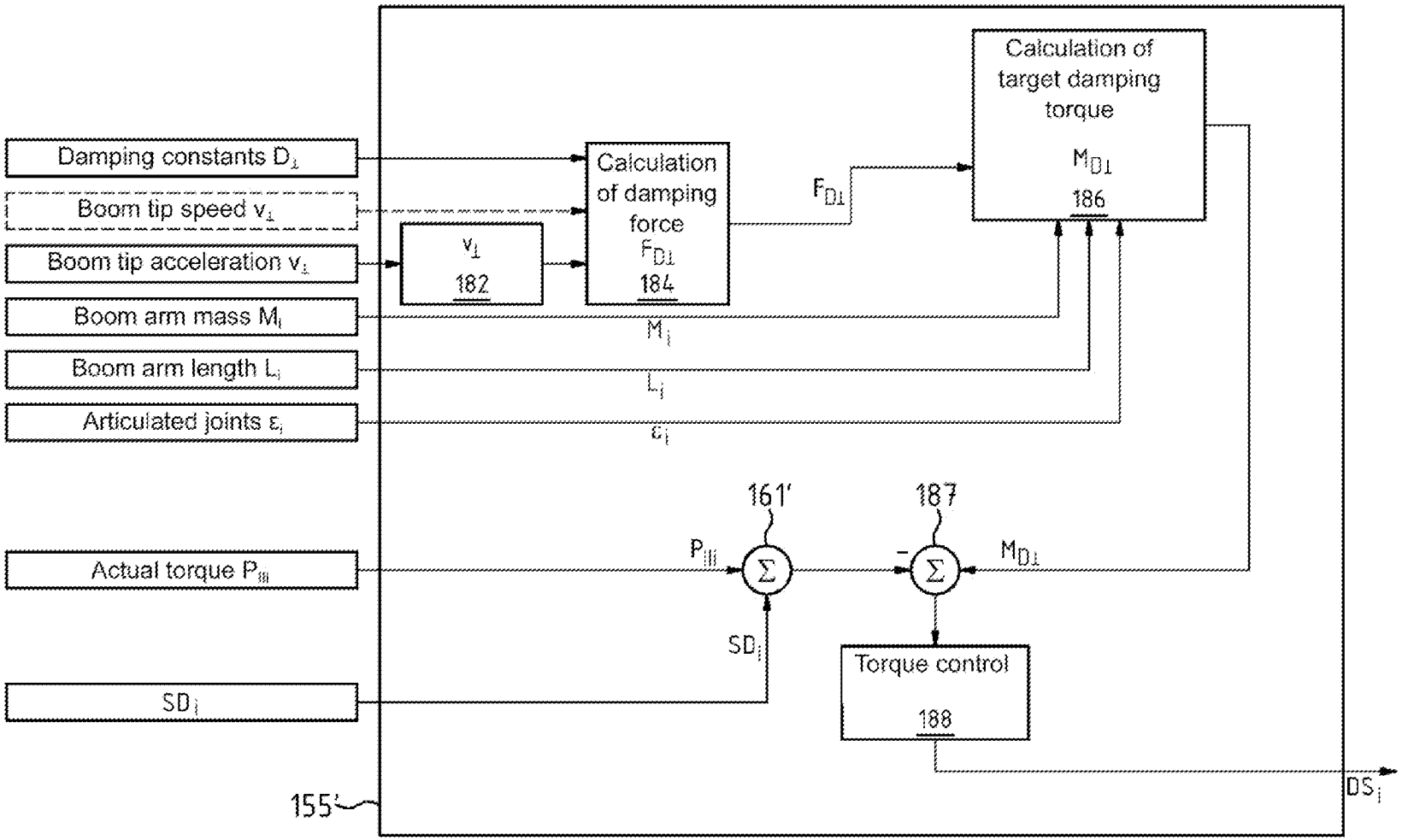
FIG. 12 is a schematic depiction of another distributor boom damping routine in the controller assembly.

FIG. 11 and FIG. 12 show the first distributor boom damping routine 154' and the further distributor boom damping routine 155' in the controller assembly 89', in the form of a block diagram in each case. Insofar as the distributor boom damping routine 154', 155' corresponds to the distributor boom damping routine 154 and 155 explained with reference to FIG. 7 and FIG. 8, respectively, these are identified by the same numbers as the reference signs.

In this case, the distributor boom damping routine 154' in turn has a calculation stage 164 for calculating the boom tip vertical speed $v_{||}$, in the plane in parallel with the axis of rotation 18 of the distributor boom 20 and the articulated boom 32 thereof, from the signal of the device 102. In a damping force calculation stage 166, the damping force $F_{D||}$ is calculated on the basis of an empirically determined damping constant $D_{||}$ that is supplied to the distributor boom damping routine 154. The calculated damping force $F_{D||}$ is then separated into a linear combination $F_{D||}=\Sigma_i n_i F_{D||}$, i=34, 36, 38, 40, 42 of individual component target damping forces $F_{D||i}$, in a separation stage 170, by means of a separation algorithm which is continuously optimized in an optimization stage 168 designed as an adjustment stage, the following applying:

$$\sum_i n_i = 1$$

Based on the physical variables known for the distributor boom 20, i.e., the mass $m_i$, i=44, 46, 48, 50, 52 and the length $l_i$, i=44, 46, 48, 50, 52 of the boom arms 44, 46, 48, 50, 52 and the articulating angles $\varepsilon_i$, i=34, 36, 38, 40, 42 of the articulated joints 34, 36, 38, 40, 42, the target torques $MS_i$, i=54, 56, 58, 60, 62 to be generated by means of the drive units 68, 78, 80, 82 and 84, in the joint axes 54, 56, 58, 60, 62 of the articulated joints 34, 36, 38, 40, 42 are then generated in an axial torque calculation stage 172. The adjustment forces of the drive units 68, 78, 80, 82 and 84 that are required for generating the target torques $MS_i$ are then determined, in the calculation stage 174, as the component target damping forces $F_{D||i}$, i=34, 36, 38, 40, 42 to be generated by means of the drive units 68, 78, 80, 82 and 84, in the joint axes 54, 56, 58, 60, 62 of the articulated joints 34, 36, 38, 40, 42.

The distributor boom damping routine 154 includes, as a device 176 for determining the actual force, a force calculation routine which contains the signals of the pressure sensors 130, 132, 134, 136, 138, 140, 142, 144, 146, 148 associated with the drive units 68, 78, 80, 82 and 84, in order to thereby determine, on the basis of the geometric dimensions of the hydraulic cylinders of the drive units 68, 78, 80, 82 and 84, the generated actual force $F_i$, i=68, 78, 80, 82, 84 which is introduced into the boom arms 44, 46, 48, 50, 52.

In contrast to the distributor boom damping routine 154, the distributor boom damping routine 154' also receives the positioning control variables $SD_i$ directly from the distributor boom control routine 156, in order to supply it to the difference routine 177 in a superimposition routine 160' for superimposition on the actual force $F_i$. From the difference routine 177, the control stage 178 receives, as a controlled variable, the difference between the actual force $F_i$, i=68, 78, 80, 82, 84 generated in each case by the drive units 68, 78, 80, 82 and 84 having superimposed positioning control variables $SD_i$, and the corresponding target component damping force $F_{D||i}$, i=34, 36, 38, 40, 42, in order to thereby generate the damping control variable $DS_i$, i=92, 94, 96, 98, 100 for the actuating element 92, 94, 96, 98, 100 associated with the drive units 68, 70, 80, 82, 84 in each case, which control variable is output at the superimposition routine 160.

In turn, the distributor boom damping routine 155' has a calculation stage 182 for calculating the boom tip horizontal speed $v\perp$ in the plane perpendicular to the axis of rotation 18 of the distributor boom 20 in which the boom tip 64 is arranged. In a damping force calculation stage 184, the damping force $F_D\perp$ is calculated on the basis of an empirically determined damping constant $D\perp$ supplied to the distributor boom damping routine 155.

Based on the physical variables known for the distributor boom 20, i.e., the mass $m_i$ and length $l_i$, i=44, 46, 48, 50, 52 of the boom arms 44, 46, 48, 50, 52, and the articulating angles $\varepsilon_i$, i=34, 36, 38, 40, 42 of the articulated joints, the target damping torque $M_D\perp_{26}$ to be generated by the drive unit 26 is then calculated in a torque calculation stage 186.

The distributor boom damping routine 155' is supplied with the actual torque $MI_i$, i=26, generated by means of the drive unit 26, and, in contrast to the distributor boom damping routine 155, also the corresponding positioning control variable $SD_i$, i=26, in order to superimpose thereon, in a superimposition routine 161', the actual torque $MI_i$, i=26 generated by the drive unit 26, about the axis of rotation 18, and to then perform the difference routine 187. The difference routine 187 determines the difference between the actual torque $MI_i$, i=26 generated by the drive unit 26, about the axis of rotation 18 with the superimposed positioning control variable $SD_i$, i=26, and the corresponding target damping torque $M_D\perp_{26}$. This difference forms a controlled variable for the torque control stage 188, which thus generates a damping control variable $DS_i$, i=90 for the actuating element 90 of the drive unit 26, which is finally output to the superimposition routine 161.

Figure 13:
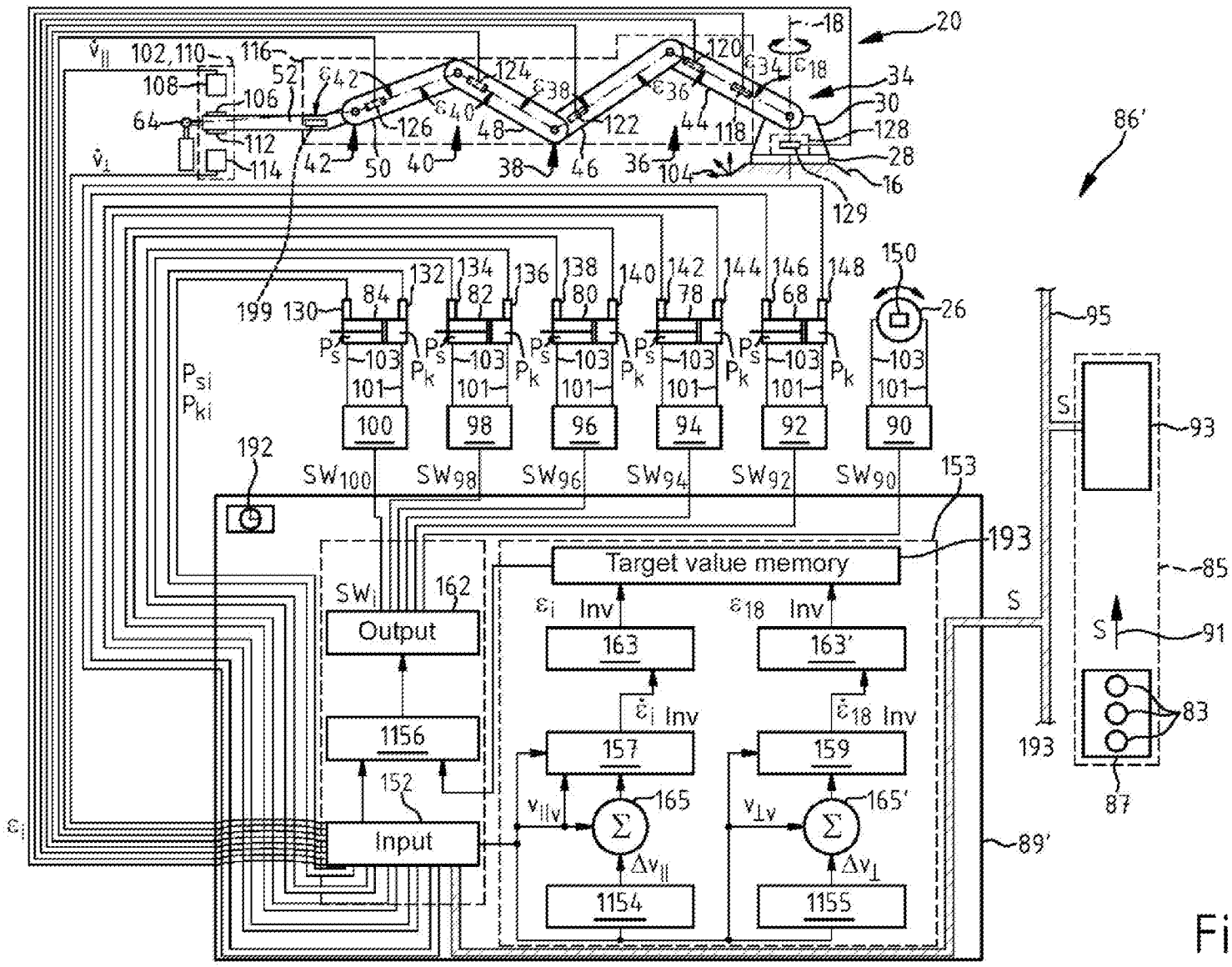
FIG. 13 is a schematic depiction of a diagram of a further control device for controlling the movement of the distributor boom with a controller assembly.
Figure 14:
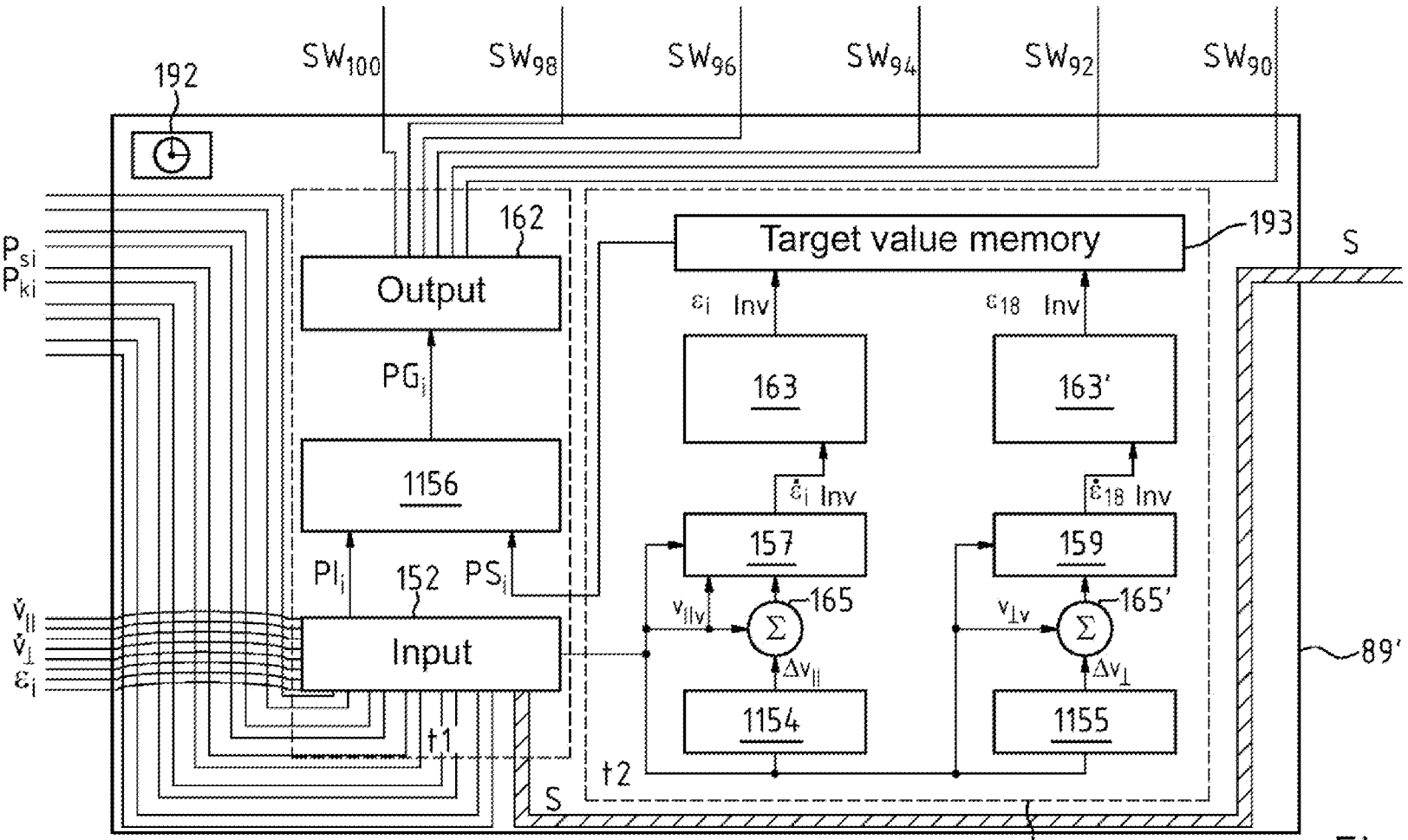
FIG. 14 is schematic depiction of a partial view of the second control device with the controller assembly.
Figure 15:
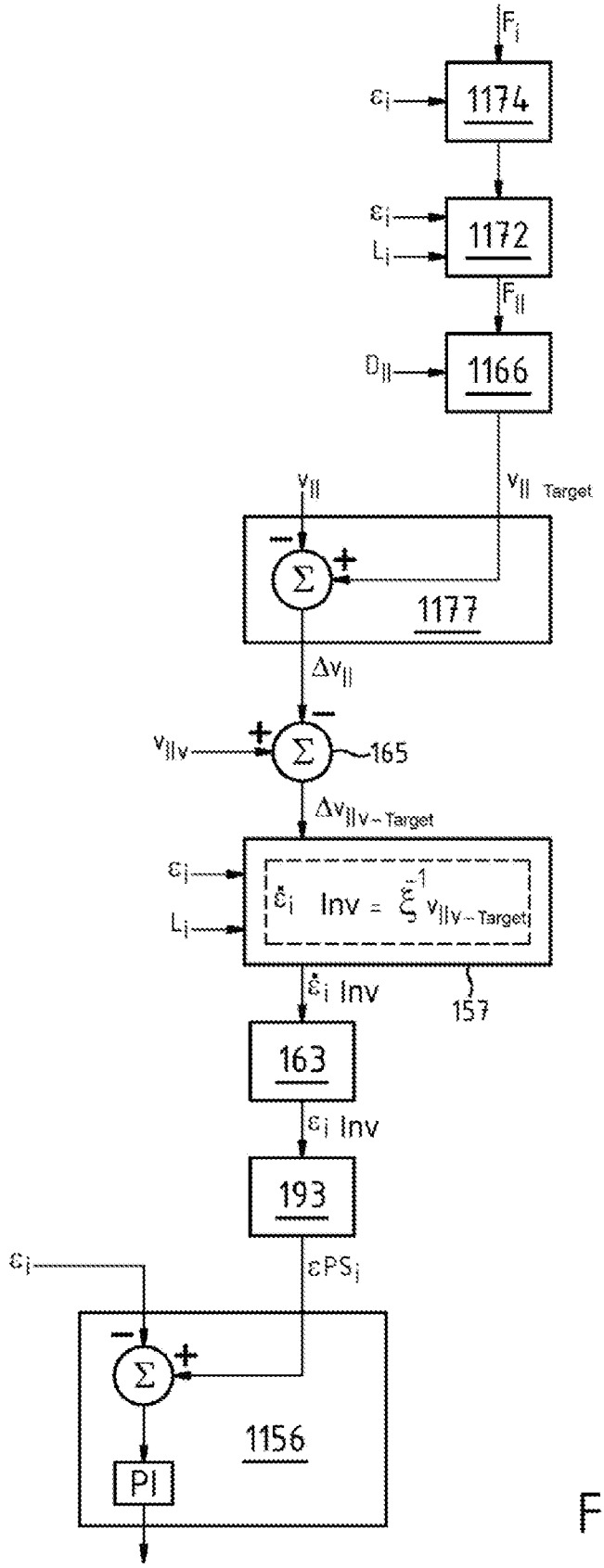
FIG. 15 and FIG. 16 illustrate a flowchart for variables processed in the controller assembly.
Figure 16:
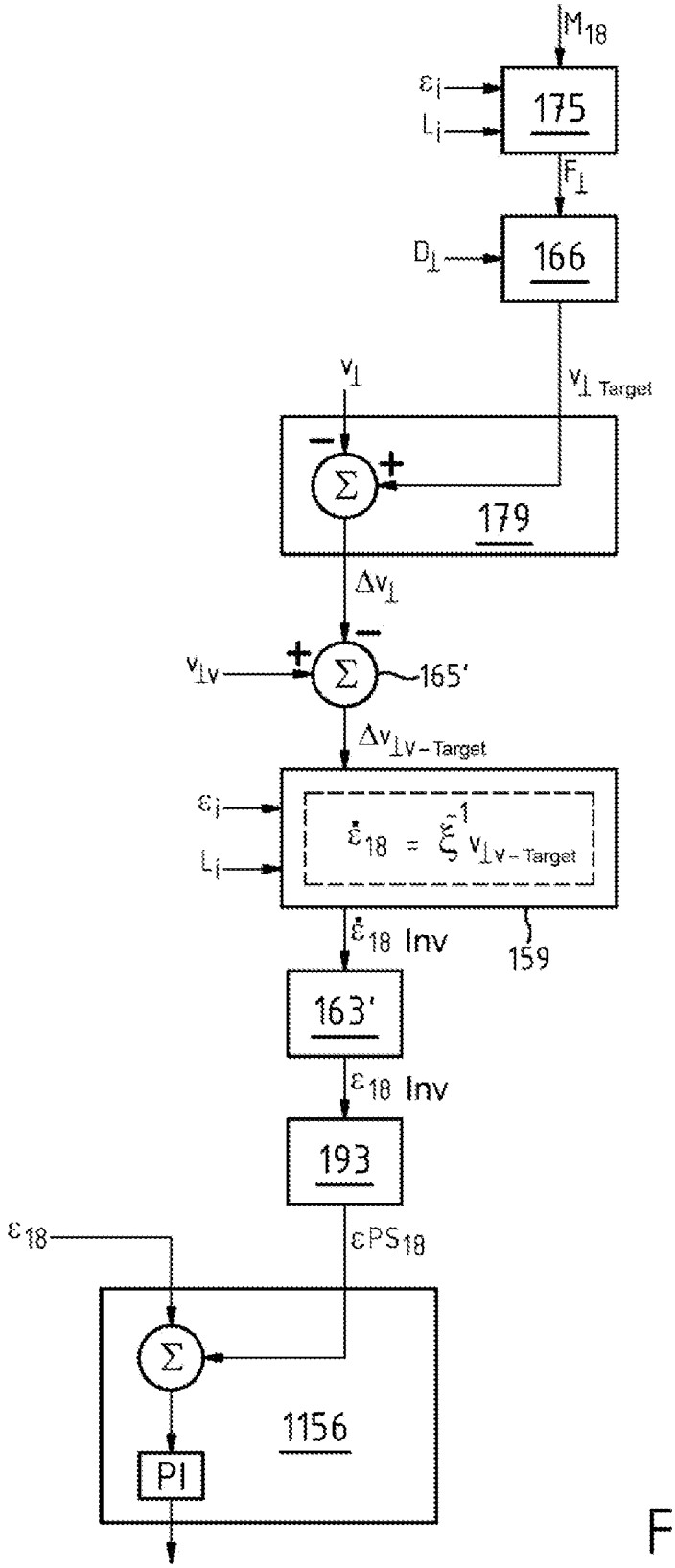
Figure 17:
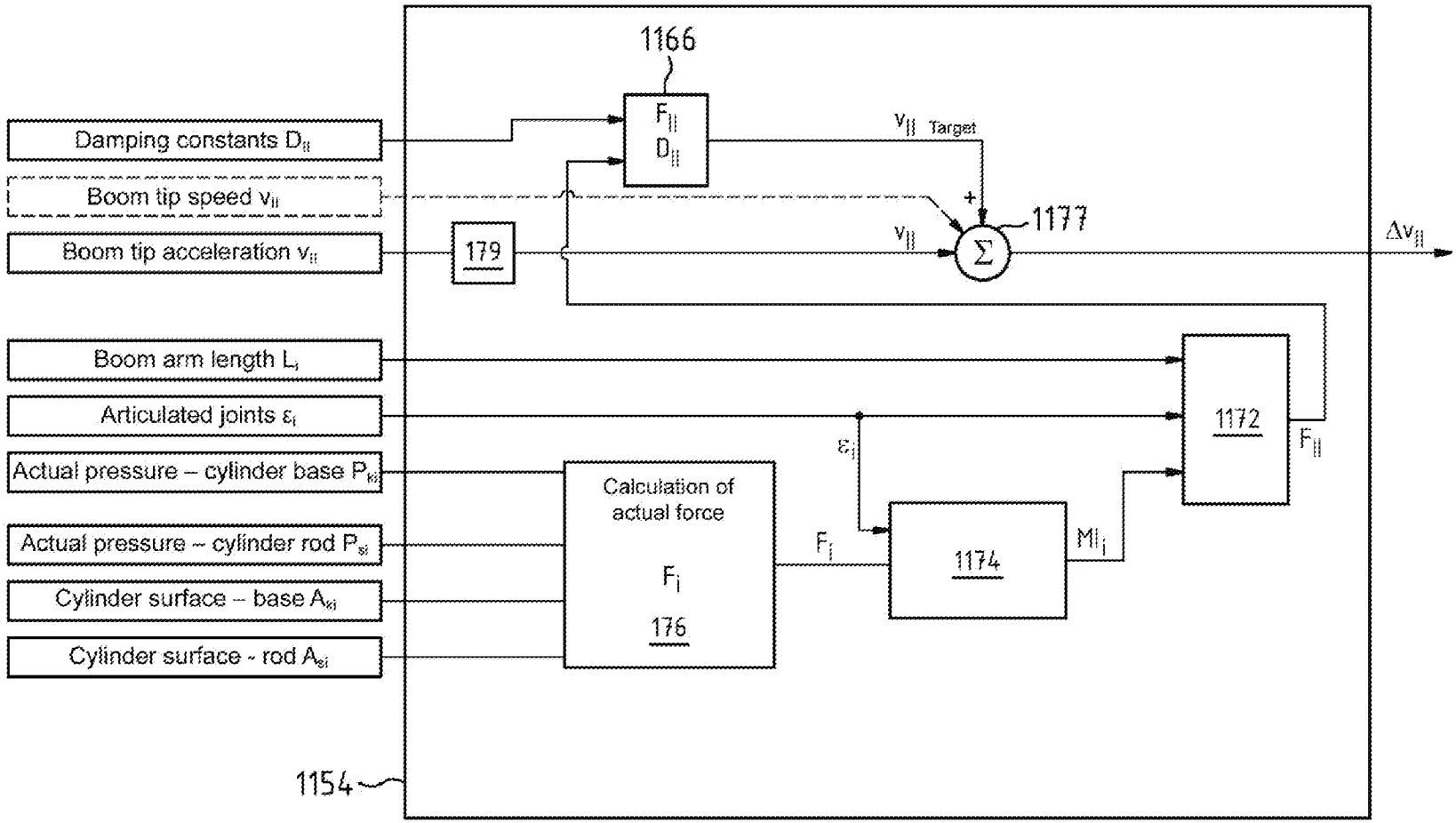
FIG. 17 is a schematic depiction of a distributor boom vertical damping routine in the controller assembly.
Figure 18:
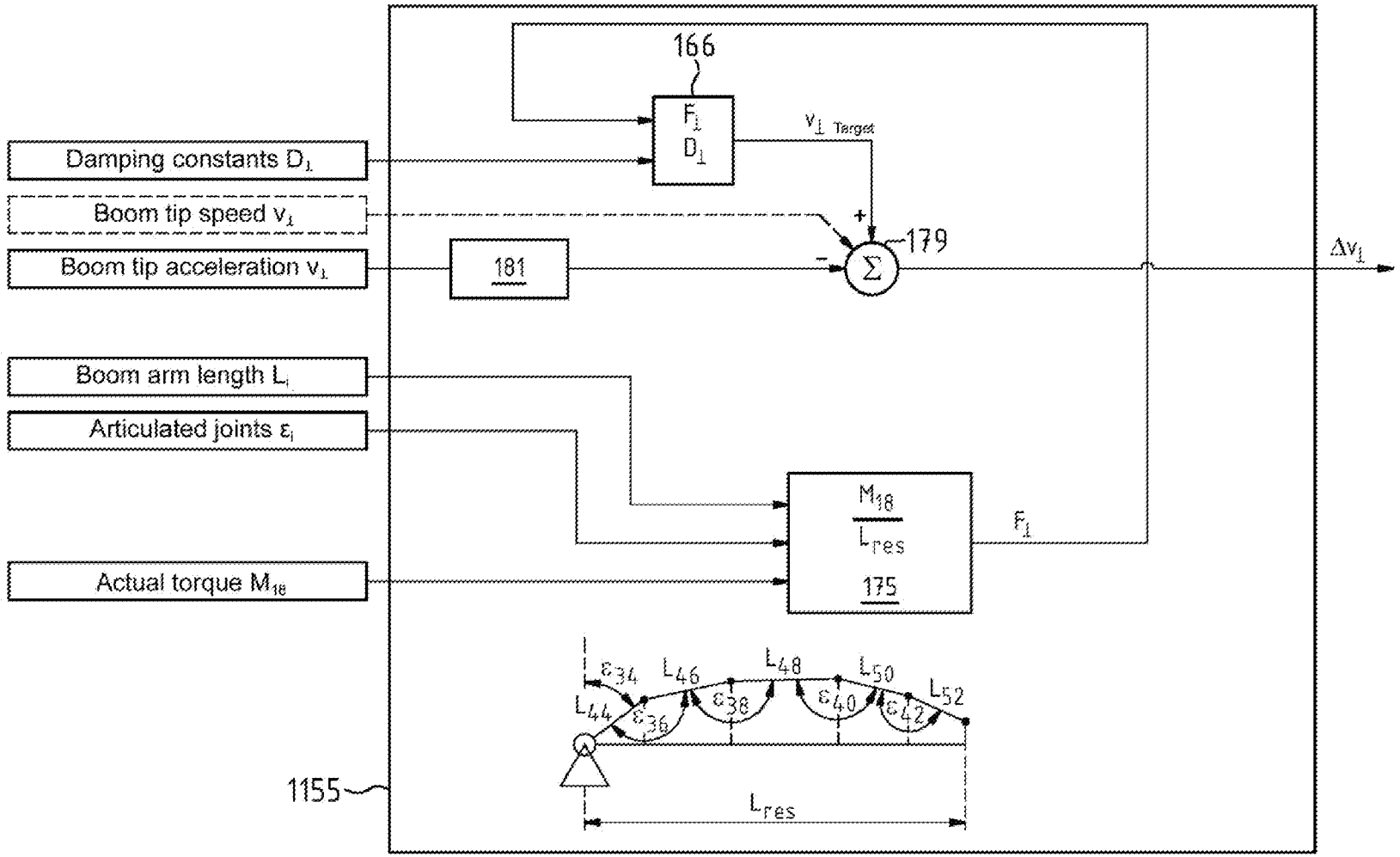
FIG. 18 is a schematic depiction of a horizontal distributor boom damping routine in the controller assembly.

FIG. 13 is a diagram of a further control device 86', which is an alternative to the first control device described above, for controlling the movement of the distributor boom 20 with a controller assembly 89' in a further large manipulator, the structure of which corresponds to the structure of the large manipulator described with reference to FIG. 1 and FIG. 4. This large manipulator also includes an articulated boom 32 which can be pivoted on a boom pedestal 30 and which is received on a frame 16 fixed to the vehicle and which can be rotated about a vertical axis 18, fixed to the vehicle, on a swivel joint 28.

Insofar as the assemblies and elements of the further control device 86' correspond to the assemblies and elements of the first control device 86, these are identified by the same reference symbols.

In addition, in the further large manipulator, the further control device 86' serves to control the movement of the boom arms of the articulated boom 32. The further control device 86' controls the movement of the articulated boom 32 with the aid of actuating elements 90, 92, 94, 96, 98, 100 for the drive units 26, 68, 78, 80, 82, and 84 associated with the articulated joints 34, 36, 38, 40, 42 and the swivel joint 28.

As a result of the program-controlled activation of the drive units 26, 68, 78, 80, 82, and 84 which are associated, individually, with the articulating axes 54, 56, 58, 60, and 62 and the axis of rotation 18, the articulated boom 32 can be unfolded at different distances and/or height differences between the concreting point 25 and the vehicle location (see, e.g., FIG. 2 and FIG. 3).

Here, too, the boom operator controls the distributor boom 20 by means of, e.g., a control assembly 85 with a controller 87. The controller 87 is designed as a remote control and includes operating elements 83 for adjusting the distributor boom 20 with the articulated boom 32, which remote control generates control signals S which can be fed to a controller assembly 89.

The control signals S are transmitted via a radio link 91 to a vehicle-mounted radio receiver 93 which is connected, on the output side, to the controller assembly 89 by means of a bus system 95 that is designed, for example, as a CAN bus.

The control device 86' includes a device 102, shown in FIG. 13, for determining the boom tip vertical speed $v_{||}$ in the plane defined by the axis of rotation 18 and the boom tip 64 and parallel to the articulated boom 32, in a coordinate system 104 that is referenced to the frame 16. The device 102 for determining the boom tip vertical speed $v_{||}$ includes an acceleration sensor 106 which is arranged on the boom arm 52 and is combined with an evaluation stage 108. Based on the signal $v'_{||}$ of the acceleration sensor 106, the boom tip vertical speed $v_{||}$ is determined, in the controller assembly 89', by means of integration over time in the (usually vertical) plane in parallel with the articulated boom 32, and in which the axis of rotation 18 of the boom pedestal 30 and the boom tip 64 lie.

In addition, the control device 86' includes a device 110 for determining the boom tip horizontal speed v⊥ in the plane perpendicular to the axis of rotation 18 of the boom pedestal 30 in which the boom tip 64 is located. The device 110 for determining the boom tip horizontal speed v⊥ includes an acceleration sensor 112 which is arranged on the boom arm 52 and which is combined with an evaluation stage circuitry 114. Based on the signal $v'_{\perp}$ from the acceleration sensor 112, the boom tip horizontal speed v⊥ is determined in the controller assembly 89' in the (usually horizontal) plane perpendicular to the axis of rotation 18 of the boom pedestal 30.

It should be noted that, in a further embodiment of the large manipulator that is an alternative to the embodiment described above, in addition or as an alternative to devices 102, 110 for determining the boom tip speed, a device can also be provided which is used for determining the speed of a boom arm location on one of the boon arms that is different from the boom tip 64 of the articulated boom 32. It should also be noted that, in principle, multiple devices can also be provided which are used to determine the speed of a boom arm location on one of the boom arms that is different from the boom tip 64 of the articulated boom 32. In particular, the large manipulator can include acceleration sensors 106', 112' for this purpose, which are arranged on the boom arms 44, 46, 48 and 50 of the articulated boom 32 (see FIG. 2).

It should also be noted that, in a further alternative embodiment of the large manipulator, it may be possible for the controller assembly 89' to receive the speed of a portion of a boom arm determined by a device for determining the speed of a boom arm location on a boom arm, e.g., the speed of the boom tip, without this having to be calculated in the controller assembly 89'.

The control device 86' also includes a device 116 for determining the articulating angles $\varepsilon_i$, i=34, 36, 38, 40, 42 of the articulated joints 34, 36, 38, 40, 42 using angle sensors 118, 120, 122, 124, 126, and 199, and a device 128 for determining the angle of rotation $\varepsilon_i$, i=18 about the vertical axis 18 of the swivel joint 28 using an angle sensor 129.

There are pressure sensors 130, 132, 134, 136, 138, 140, 142, 144, 146, 148 in the control device 86' which are associated with the drive units 26, 68, 78, 80, 82, and 84 designed as hydraulic cylinders. These pressure sensors are used to measure the rod-side pressure $p_{Si}$, i=130, 134, 138, 142, 146, and the piston-side pressure $p_{Ki}$ i=132, 136, 140, 144, 148, of the hydraulic oil. The pressure sensors 130, 132, 134, 136, 138, 140, 142, 144, 146, 148 enable the determination of the actual force $F_i$, i=68, 78, 80, 82, 84, which is generated by means of the drive units 68, 78, 80, 82 and 84, and is generated and introduced into the boom arms 44, 46, 48, 50, 52 of the articulated boom 32.

Regarding the drive unit 26 designed as a hydraulic rotary drive, the control device 86' includes a torque sensor 150 which is designed to detect the actual torque $M_i$, i=18 introduced into the boom pedestal 30 as a torque, by means of the rotary drive.

The controller assembly 89' is used to control the actuating elements 90, 92, 94, 96, 98, 100 of the drive units 26, 68, 78, 80, 82 and 84. The actuating elements 90, 92, 94, 96, 98, 100 are designed as proportional shuttle valves, the output lines 101, 103 of which are connected, on the bottom and on the rod side, to the drive units 68, 78, 80, 82, and 84 designed as double-acting hydraulic cylinders, or as hydraulic motors.

The controller assembly 89' generates actuating signals $SW_i$, i=90, 92, 94, 96, 98, and 100 for the actuating elements of the drive units of the distributor boom 20 on the basis of the control signals S from the control assembly 85. By means of controlling the actuating elements 90, 92, 94, 96, 98, 100, the postures of the distributor boom 20 are adjusted to target values $W_{target}$ that can be specified by the control assembly 85, by evaluating the position of the articulating angles $\varepsilon_i$, i=34, 36, 38, 40, 42 of the articulated joints 34, 36, 38, 40, 42, detected by the angle sensors 118, 120, 122, 124 and 126, by means of the angle sensors 118, 120, 122, 124, and 126, and of the angle of rotation $\varepsilon_i$, i=18 of the boom pedestal 30 about the axis of rotation 18, detected by the angle sensor 129.

The controller assembly 89 has an input routine 152, by means of which the device 102 for determining the boom tip vertical speed $v_{||}$, the device 110 for determining the boom tip horizontal speed v⊥ in a plane perpendicular to the axis of rotation 18 of the boom pedestal 30, and the device 116 for determining the articulating angles $\varepsilon_i$, i=18 of the articulated joints 34, 36, 38, 40, 42 by means of the angle sensors 118, 120, 122, 124, and 126, and the device 128 for determining the angle of rotation $\varepsilon_i$, i=18 about the vertical axis 18 of the swivel joint 28 is continuously queried by means of the angle sensor 129 having a cycle time t1. According to the invention, the cycle time t1 is very much shorter than the characteristic period $T_G$ of a fundamental oscillation of the distributor boom. It is advantageous if the cycle time t1 is also very much smaller than a characteristic period $T_n$ of a first, second, third, or even higher harmonic of the distributor boom.

The input routine 152 also continuously receives the rod-side and piston-side pressures $p_{Si}$, $p_{Ki}$ as signals from the pressure sensors 130, 132, 134, 136, 138, 140, 142, 144, 146, 148. The control signals S are also read from the control assembly 85 by means of the input routine 152.

The controller assembly 89' also includes a routine complex 153 with a distributor boom vertical damping routine 1154 and a distributor boom horizontal damping routine 1155, and a distributor boom control routine 1156. The distributor boom damping routines 1154, 1155 and the routines in the routine complex 153 with the distributor boom control routine 1156 operate in step with the processor clock 192 and are called up in the controller assembly 89'.

In the controller assembly 89', there is an output routine 162 which outputs control signals $SW_i$, i=90, 92, 94, 96, 98, 100 to the actuating elements 90, 92, 94, 96, 98, and 100. The distributor boom control routine 1156 provides the output routine 162 with controlled posture values PGi.

FIG. 6 is an enlarged view of the controller assembly 89'. FIG. 7, FIG. 8, FIG. 9, and FIG. 10 serve to explain the control algorithm of the distributor boom vertical damping routine 1154 and the distributor boom horizontal damping routine 1155 in the controller assembly 89'.

The distributor boom vertical damping routine 1154 receives the signals $p_{Si}$, $p_{Ki}$ of the pressure sensors 130, 132, 134, 136, 138, 140, 142, 144, 146, 148 from the input routine 152 at the cycle time t2≥t1. In this case, the cycle time t2 preferably satisfies the following relationship: $T_G$>>t2.

The distributor boom vertical damping routine 1154 also receives the articulating angles $\varepsilon_i$, i=34, 36, 38, 40, 42 detected by the device 116 and the boom tip vertical speed $v_{||}$ determined by the device 102 at the cycle time t2≥t1 supplied by the input routine 152. In addition, configuration data of the large manipulator, from the group of rod-side cylinder surfaces Aki and bottom-side cylinder surfaces Asi, stored in a data memory, are fed into the distributor boom vertical damping routine 1154, from the input routine 152, at the cycle time t2≥t1.

The distributor boom vertical damping routine 1154 has a device 176 for calculating the actual force $F_i$, which is generated in each case by means of the drive units 26, 68, 78, 80, 82 and 84. For this purpose, the device 176 for calculating the actual force $F_i$ receives the signals $p_{Si}$, $p_{Ki}$ from the pressure sensors 130, 132, 134, 136, 138, 140, 142, 144, 146, 148 and calculates therefrom, on the basis of the rod-side and base-side cylinder surfaces Aki, Asi of the pistons in the hydraulic cylinders, the actual force $F_i$ provided by a drive unit 26, 68, 78, 80, 82, and 84 in each case.

In a calculation stage 1174 of the distributor boom vertical damping routine 1154, the calculated actual forces $F_i$ are converted into actual torques $M_i$ on the basis of the determined articulating angles $\varepsilon_i$, i=34, 36, 38, 40, 42, and on the basis of the known physical variables of the distributor boom 20.

Then, in a force calculation stage 1172, a vertical force $F_{||}$ acting on the boom tip 64 is determined from said actual torque $M_i$, on the basis of the articulating angles $\varepsilon_i$, i=34, 36, 38, 40, 42 and based on the known physical variables of the distributor boom 20, in particular based the length $l_i$ of the boom arms 44, 46, 48, 50, and 52.

The distributor boom vertical damping routine 1154 includes a target speed calculation stage 1166. The nominal speed calculation stage 1166 converts the calculated vertical force $F_{||}$ acting on the boom tip 64 into a target vertical speed $v_{||target}$ for the boom tip 64 through division by an empirical constant $D_{||}$.

The distributor boom vertical damping routine 1154 also includes a difference routine 1177. In the difference routine 1177, the target vertical speed $v_{||Target}$ of the boom tip 64 is compared with the boom tip vertical speed $v_{||}$ which is calculated in the distributor boom vertical damping routine 1154, either by temporal integration of the signal $v'_{||}$ of the acceleration sensor 106 as a value of the boom tip acceleration in the integration stage 181, or which is supplied to the distributor boom vertical damping routine 1154 as a measured variable.

The difference routine 1177 forms the target vertical speed $v_{||target}$ of the boom tip 64 and the boom tip vertical speed $v_{||}$ of the vertical comparison value $\Delta v_{||}$ as the difference between the target vertical speed $v_{||target}$ for the boom tip 64 and the boom tip vertical speed $v_{||}$.

The vertical comparison value $\Delta v_{||}$ is then fed to a differential element 165 in the routine complex 153 in the controller assembly 89'. The difference element 165 receives the default boom tip vertical speed $v_{||V}$ set by the boom operator on the control panel 83 of the control assembly 85 at the cycle time t2≥t1 from the input routine 152. The task of the difference element 165 is to determine the difference between the default boom tip vertical speed $v_{||V}$ and the vertical comparison value $\Delta v_{||}$ defined above, and to supply this variable to a vertical reverse transformation routine 157 in the routine complex 153 of the controller assembly 89 as a default target boom tip vertical speed $v_{||V\text{-}TARGET}$.

The horizontal inverse transformation routine 157 converts the default target boom tip speed $v_{||V\text{-}TARGET}$, on the basis of the articulating angle $\varepsilon_i$ of the joints supplied with the cycle time t2≥t1 from the input routine 152 and based on known physical variables of the distributor boom 20, in particular the length $l_i$ of the boom arms 44, 46, 48, 50, and 52, and on the basis of the default boom tip vertical speed set by the boom operator on the control panel 83 of the control assembly 85, into a corresponding inverse transformation angular velocity $\dot{\varepsilon}_{i\ Inv}$ of the articulated joints 34, 36 38, 40, 42.

This inverse transform angular velocity $\dot{\varepsilon}_{i\ Inv}$ is then fed, in the controller assembly 89, to an angular velocity calculation stage 163 designed as an integration stage, in the routine complex 153, which stage integrates the inverse transformation angular velocity $\dot{\varepsilon}_{i\ Inv}$, over a constant time interval Δt, to form a target angle $\varepsilon_{i_target}$, i=34, 36, 38, 40, 42, i.e., to the target values for the angles $\varepsilon_i$ of the boom arms 44, 46, 48, 50, and 52, in order to then store them in the target value memory 193 in the routine complex 153. These setpoint values of the angles $\varepsilon_i$ of the boom arms 44, 46, 48, 50, and 52 define the boom posture of the distributor boom 20.

From this target value memory 193, the target posture values $\varepsilon_{PSi}$ are continuously fed to the distributor boom control routine 1156.

The distributor boom horizontal damping routine 1155 receives, from the input routine 152 at the cycle time t2≥t1 from the input routine 152, the signals of the torque sensor 150 for the detection of the actual torque $M_i$, i=18 introduced into the boom pedestal 30 as a torque by means of the rotary drive.

In a calculation stage 175 in the distributor boom horizontal damping routine 1155, the actual torque $M_i$, i=18 is converted, on the basis of the determined articulating angles $\varepsilon_i$, i=34, 36, 38, 40, 42 and on the basis of the known physical variables of the distributor boom 20, into a horizontal force F⊥ acting on the boom tip 64 of the distributor boom.

The distributor boom horizontal damping routine 1155 includes a target speed calculation stage 1166. The target speed calculation stage 1166 converts the calculated horizontal force F⊥ acting on the boom tip 64, by means of division by an empirically determined constant D⊥, into a target horizontal speed $v\perp_{Target}$ for the boom tip 64.

The distributor boom horizontal damping routine 1155 also includes a difference routine 179. In the difference routine 179, the target horizontal speed $v\perp_{Target}$ of the boom tip 64 is compared with the horizontal boom tip speed v⊥ which is calculated, in the distributor boom vertical damping routine 1154, either by temporal integration of the signal $v'_{\perp}$ of the acceleration sensor 112, as a value of the boom tip acceleration, in the integration stage 181, or which is alternatively supplied to the distributor boom vertical damping routine 1154 as a measured variable.

The difference routine 179 forms, based on the target horizontal speed $v\perp_{Target}$ of the boom tip and the horizontal boom tip speed v⊥, the horizontal comparison value Δv⊥, as the difference between the target horizontal speed $v\perp_{Target}$ of the boom tip 64 and the horizontal boom tip speed v⊥.

The horizontal comparison value Δv⊥ is then fed to a further differential element 165' in the routine complex 153, in the controller assembly 89'. The difference element 165' receives the default horizontal boom tip speed $v\perp_V$ set by the boom operator on the control panel 83 of the control assembly 85 at the cycle time t2≥t1 from the input routine 152.

The task of the further difference element 165' is to form the difference between the default horizontal boom tip speed $v\perp_V$ provided by the input routine 152 at the cycle time t2≥t1, and the horizontal comparison value $\Delta v\perp$ defined above, and to feed this variable, which corresponds to a circular arc speed of the boom tip 64, into the routine complex 153 of the controller assembly 89' as a default target horizontal boom tip speed $v\perp_{V\text{-}TARGET}$ of a horizontal inverse transformation routine 159.

The horizontal reverse transformation routine 159 converts the default target boom tip speed $v\perp_{V\text{-}TARGET}$ based on the articulating angle $\varepsilon_i$ of the joints supplied with the cycle time t2≥t1 from the input routine 152 and based on known physical variables of the distributor boom 20 into a corresponding reverse transformation angular velocity $\dot{\varepsilon}_{18\ Inv}$ of the swivel joint 28 about the vertical axis 18.

This inverse transformation angular velocity $\dot{\varepsilon}_{18Inv}$ is then fed, in the controller assembly 89', to a further angular velocity calculation stage 163' designed as an integration stage, in the routine complex 153, which integrates the inverse transformation angular velocity $\dot{\varepsilon}_{18Inv}$ over a constant time interval $\Delta t$ to form a target value angle $\varepsilon_{18Inv}$, in order to then also store this in the target value memory 193.

Based on this target value memory 193, the target posture values $PS_i$ are fed continuously to the distributor boom control routine 1156.

The distributor boom control routine 1156 receives actual posture values $PI_i$ from the input routine 152 in the form of actual values of the angles $\varepsilon_i$ detected by means of the angle sensors 118, 120, 122, 124, 126, 129. Using a control loop implemented in the distributor boom control routine 1156, the positioning control variables $SD_i$, i=90, 92, 94, 96, 98, 100 for the actuating elements 90, 92, 94, 96, 98, and 100 of the drive units 26, 68 78, 80, 82, 84 are then determined in the controller assembly 89 based on the actual posture values $PI_i$ and the target posture values $PS_i$.

The positioning control variables $SD_i$, i=90, 92, 94, 96, 98, 100 for the actuating elements 90, 92, 94, 96, 98, and 100 are fed to an output routine 162. The latter routes corresponding control signals $SW_i$, i=92, 94, 96, 98, 100, which are formed as control signals from the positioning control variables $SD_i$, to the actuating elements 92, 94, 96, 98, and 100.

It should be noted that, in an alternative embodiment of the controller assembly 89, it may be possible for the routines in the routine complex 153 to take into account only every nth signal from the group consisting of actual posture values $PI_i$, signals $p_{Si}$, $p_{Ki}$ from the pressure sensors, default boom tip vertical speed $v_{\|V}$, articulating angles $\varepsilon_i$ of the joints, etc., provided by the input routine 152 at cycle time t1.

Where the cycle time t2 satisfies the relationship: $T_G$>>t2, or that for every nth signal from the aforementioned group, provided by input routine 152 at cycle time t1, the following applies: $T_G$>>n t1, a runtime behavior of the routines in the controller assembly 89' which optimizes computing time and which are used for the active damping of undesired vibrations of the large manipulator of the truck-mounted concrete pump 10, can be achieved. The frequency of calls to the vertical inverse transformation routine 157 and the horizontal inverse transformation routine 159 is minimized in this way, and the frequency of calls to the input routine 152 and the distributor boom control routine 1156 in the controller assembly 89' is maximized in this way. In the case of the large manipulator, this has the effect of optimizing the runtime behavior overall.

In summary, the following advantageous features of the disclosed embodiments should be noted: A large manipulator for concrete pumps comprises a distributor boom 20. The distributor boom 20 comprises an articulated boom 32, which is mounted on the boom pedestal 30 and is made up of multiple boom arms 44, 46, 48, 50, 52 connected to one another in an articulated manner and having a boom tip 64 and multiple joints 34, 36, 38, 40, 42 for pivoting the boom arms 44, 46, 48, 50, 52 with respect to the boom pedestal 30 or an adjacent boom arm 44, 46, 48, 50, 52, and includes a control device 86 for controlling the movement of the articulated boom 32 with the aid of drive unit actuating elements 90, 92, 94, 96, 98, 100 for drive units 68, 78, 80, 82, 94 respectively associated with the articulated joints 34, 36, 38, 40, 42. The large manipulator includes a device 102 for determining the vertical speed $v_{\|}$ and/or horizontal speed $v\perp$ of a boom arm location on at least one boom arm 44, 46, 48, 50, 52 in a coordinate system 104 referenced to the frame 16. Said large manipulator also comprises a device for determining the articulating angles 116 of the joints 34, 36, 38, 40, 42. The control device 86 controls the movement of the articulated boom 32 by providing positioning control variables $SD_i$ for the actuating elements 90, 92, 94, 96, 98, 100 of the drive units 68, 78, 80, 82, 84, which positioning control variables depend on a vertical speed $v_{\|}$ and/or horizontal speed $v\perp$ of the boom arm location determined by the device 102 for determining a vertical speed $v_{\|}$ of a boom arm location, and on the articulating angles $\varepsilon_i$ of the joints 34, 36, 38, 40, 42 determined by means of the device 116 for determining the articulating angles of the joints 34, 36, 38, 40, 42, and/or on an angle of rotation $\varepsilon_{18}$ of the boom pedestal 30 about a vertical axis 18, and on control signals S for adjusting the distributor boom 20 generated by a controller 87 that can be operated by a boom operator.

LIST OF REFERENCE NUMBERS

10 Truck-mounted concrete pump
12 Transport vehicle
14 Thick matter pump
16 Vehicle-mounted frame
18 Axis of rotation (vertical axis)
20 Distributor boom
22 Concrete delivery line
24 Feed container
25 Concreting point
26 Drive unit
28 Swivel joint
30 Boom pedestal
32 Articulated boom
34, 36, 38, 40, 42 Articulated joints
44, 46, 48, 50, 52 Boom arms
54, 56, 58, 60, 62 Articulation axes
64 Boom arm location, e.g., boom tip
66 End hose
68 Drive unit
70 Cylinder part
72 Cylinder rod
74 Lever element
76 Guide element
77 Double arrow
78, 80, 82, 84 Drive unit
83 Control panel
85 Control assembly

86, 86' Control device
87 Controller
89, 89' Controller assembly
90, 92, 94, 96, 98, 100 Actuating elements
91 Radio link
93 Radio receiver
95 Bus system
101 Output line
102 Device for determining vertical speed
103 Output line
104 Coordinate system
106, 106' Acceleration sensor
108 Evaluation stage/Computer stage
110, 110' Device for determining horizontal speed
112, 112' Accelerometer
114 Evaluation level
116 Device for determining the articulating angles
118, 120, 122, 124, 126 Angle sensor
128 Device for determining the angle of rotation
129 Angle sensor
130, 132, 134, 136, 138,
140, 142, 144, 146, 148 Pressure sensor
150 Torque sensor
152 Input routine
153 Routine complex
154, 154' Distributor boom damping routine
155, 155' Distributor boom damping routine
156 Distributor boom control routine
157 Vertical reverse transformation routine
158 Distributor boom target posture value routine
159 Horizontal inverse transformation routine
160, 160' Superimposition routine
161, 161' Superimposition routine
162 Output routine
163, 163' Angular velocity calculation stage
164 Calculation stage
165, 165' Difference element
166 Damping force calculation stage
168 Optimization stage
170 Decomposition stage
172 Axis torque calculation stage
174 Calculation stage
175 Calculation stage
176 Device for determining the actual force
177 Difference routine
178 Control stage
179 Difference routine
181 Integration stage
182 Calculation stage
184 Damping force calculation stage
186 Torque calculation stage
187 Difference routine
188 Torque control stage
192 Processor clock
193 Target value memory
194 Difference routine
196 Zero order hold filter
198 Control stage
199 Angle sensor
1154 Distributor boom vertical damping routine
1155 Distributor boom horizontal damping routine
1156 Distributor boom control routine
1166 Target speed calculation stage
1172 Force calculation stage
1174 Calculation stage
1177 Difference routine
Aki Rod-side cylinder surfaces
Asi Bottom-side cylinder surfaces
$D_{\|}$ Empirical constant
$D\perp$ Empirically determined constant
$D_{\|}$, $D\perp$ Damping constant
$DS_i$ Damping control variable
$F_{D\|}$, or $F_D\perp$ Damping force
$F_{D\|i}$ Target component damping force
$F_D$ Target damping force
$F_{Di}$ Target component damping forces
$F_i$ Actual force
$F_{\|}$ Vertical force
$F\perp$ Horizontal force
$FD_i$ Target component damping force
$l_i$ Length
$MD_i$ Target component damping torque
$m_i$ Mass
$M_i$ Actual torque
$MI_i$ Actual torque
$MS_i$ Target torque
$M_D\perp$ Target damping torque
$n_i$ Device-specific selected parameters
$p_{Ki}$ Piston-side pressure
$p_{Si}$ Rod-side pressure
PGi Posture values
$PI_i$ Actual posture value
$PS_i$ Target posture value
S Control signal
$SD_i$ Positioning control variable
$SW_i$ Control signal
$v_{\|}$ Boom tip vertical speed
$v_{\|Target}$ Target vertical speed
$v_{\|V}$ Default boom tip speed
$v_{\|V\text{-}TARGET}$ Default target boom tip vertical speed
$v\perp_{V\text{-}TARGET}$ Default target boom tip horizontal speed
$v\perp$ Horizontal boom tip speed
$v\perp_{Target}$ Target horizontal speed
$v\perp_V$ Default horizontal boom tip speed
$W_{target}$ Target value
$\varepsilon_i$ Angle
$\dot{\varepsilon}_i$ Actual angular velocity
$\varepsilon_{18Inv}$ Target angle
$\dot{\varepsilon}_{i\ Inv}$ Inverse transformation angular velocity
$\varepsilon_{18\ Inv}$ Inverse transformation angular velocity
$\varepsilon_{i_Target}$ Target angle
$\varepsilon_{PSi}$ Target posture values
$v'_{\|}$ Signal of the acceleration sensor 106
$v'_{\perp}$ Signal of the acceleration sensor 112
$\Delta v_{\|}$ Vertical comparison value
$\Delta t$ Constant time interval
$\Delta v\perp$ Horizontal comparison value While this invention has been described as having an exemplary design, the present invention may be further modified within the spirit and scope of this disclosure. This application is therefore intended to cover any variations, uses, or adaptations of the invention using its general principles.

What is claimed is:

1. A large manipulator for concrete pumps, comprising:

a distributor boom which comprises an articulated boom which is mounted on a boom pedestal and includes a plurality of boom arms connected to one another in an articulated manner and having a boom tip, and a plurality of joints for pivoting the boom arms with respect to the boom pedestal or an adjacent one of the boom arms, and said large manipulator comprising a control apparatus which controls the movement of the articulated boom with the aid of drive unit actuating elements for a plurality of drive units respectively associated with the plurality of joints, the control apparatus comprising:

a vertical speed determining device for determining the vertical speed $v_{||}$ of a boom arm location on at least one boom arm, an angle determining device for determining the articulating angles εi of the joints, wherein the control apparatus controls the movement of the articulated boom by providing positioning control variables $SD_i$ for the actuating elements of the drive units, wherein the positioning control variables are a function of a vertical speed $v_{||}$ of a boom arm location determined by the vertical speed determining device, and on the articulating angles $\varepsilon_i$ of the joints determined by the angle determining device, and on control signals S for adjusting the distributor boom generated by a boom operator controller that can be operated by a boom operator, and a controller assembly having a controller which is coupled to the vertical speed determining device and to the angle determining device and is configured to control the drive unit actuating elements in accordance with a distributor boom damping routine which:

(i) determines, based the vertical speed $v_{||}$ determined for a boom arm location by the vertical speed determining device, a damping force $F_{D||}$;

(ii) divides the determined damping force $F_{D||}$ into component damping forces associated with individual joints; and (iii) in order to control the drive unit actuating elements for damping the articulated boom, determines, based on the component damping forces and the articulating angles $\varepsilon_i$ determined by the angle determining device, for the drive units associated with the plurality of joints, as well as known physical variables of the distributor boom for damping the articulated boom, damping control variables $DS_i$ for controlling the drive unit actuating elements, wherein the damping control variables are used in determining the positioning control variables $SD_i$ for the actuating elements of the drive units, wherein the distributor boom damping routine determines, based on the component damping force associated with a joint and from the determined articulating angle of the joint, a target component damping force $FD_i$ or a target component damping torque $MD_i$ that can be generated by the drive unit associated with the joint, a force determining device for determining an actual force $F_i$ or an actual torque $M_i$ generated by the drive unit associated with the joint, wherein the distributor boom damping routine includes a control stage that determines the damping control variables $DS_i$ for the drive unit for damping the distributor boom, based on a comparison between the actual force $F_i$ generated by the drive unit and the target component damping force $FD_i$ to be generated, or from a comparison between the actual torque $M_i$ generated by the drive unit and the target component damping torque $MD_i$ to be generated, wherein the controller assembly is configured to run a distributor boom target posture value routine which converts the control signals S of the boom operator controller into target posture values $PS_i$ in the form of target values of the articulating angles $\varepsilon_i$ of the joints of the distributor boom, wherein the controller assembly is configured to run a distributor boom control routine which determines the positioning control variables $SD_i$ for the actuating elements of the drive units based on actual posture values $PI_i$ in the form of actual values, supplied to the controller assembly, of the articulating angles $\varepsilon_i$ of the joints of the distributor boom and the target posture values $PS_i$, and wherein the controller assembly is configured to run a superimposition routine which superimposes the damping control variables $DS_i$ and the positioning control variables $SD_i$ to form control signals $SW_i$ for the actuating elements of the drive units.

2. The large manipulator according to claim 1 wherein the distributor boom control routine determines the difference between actual posture values $PI_i$ and target posture values $PS_i$, processes this difference in a zero order hold filter, and supplies it, as a controlled variable, to a control stage which is performed by a PI controller and outputs the positioning control variables $SD_i$.

3. The large manipulator according to claim 1 wherein the superimposition routine is an adding routine which adds the damping control variables $DS_i$ to the positioning control variables $SD_i$.

4. A large manipulator for concrete pumps comprising:

a distributor boom which comprises an articulated boom which is mounted on a boom pedestal and includes a plurality of boom arms connected to one another in an articulated manner and having a boom tip, and a plurality of joints for pivoting the boom arms with respect to the boom pedestal or an adjacent one of the boom arms, and said large manipulator comprising a control apparatus which controls movement of the articulated boom with the aid of drive unit actuating elements for a plurality of drive units respectively associated with the plurality of joints, the control apparatus comprising:

a vertical speed determining device for determining the vertical speed $v_{||}$ of a boom arm location on at least one boom arm, an angle determining device for determining the articulating angles εi of the joints, wherein the control apparatus controls the movement of the articulated boom by providing control signals $SW_i$ for the actuating elements of the drive units, which positioning control variables are a function of a vertical speed $v_{||}$ of a boom arm location determined by the vertical speed determining device, and on the articulating angles $\varepsilon_i$ of the joints determined by the angle determining device, and on control signals S for adjusting the distributor boom generated by a boom operator controller that can be operated by a boom operator, and a controller assembly having a controller which is coupled to the vertical speed determining device and to the angle determining device and which is configured to run a distributor boom vertical damping routine and calculates the actual forces $F_i$ or actual torques $M_i$ generated by the drive units, wherein the boom operator controller supplies the controller assembly with a control signal S which is converted, in the controller assembly, into target posture values $PS_i$ in the form of target values of the articulating angles $\varepsilon_i$ of the articulated joints of the distributor boom, wherein the determined actual forces $F_i$ or actual torques $M_i$ generated by the drive units, the determined vertical speed $v_{||}$ of the boom arm location, and the determined articulating angles $\varepsilon_i$ of the plurality of joints are continuously supplied to the distributor boom vertical damping routine, wherein the distributor boom vertical damping routine:

determines, based on the supplied actual forces $F_i$ or actual torques $M_i$, and the supplied articulating angles $\varepsilon_i$ of the joints, as well as known physical variables of the distributor boom, a vertical force $F_{\|}$ acting on the boom arm location, converts the vertical force $F_{\|}$ acting on the boom arm location (64) into a vertical target speed $v_{\|Target}$ for the boom arm location, determines a vertical comparison value $\Delta v_{\|}$ between the vertical target speed $v_{\|Target}$ of the boom arm location and the vertical speed $v_{\|}$ determined for the boom arm location, the vertical comparison value $\Delta v_{\|}$ being converted, by means of an inverse transformation based on the supplied articulating angles $\varepsilon_i$ of the joints and based on known physical variables of the distributor boom into an inverse transformation angular velocity $\dot{\varepsilon}_{i\ Inv}$ of the plurality of joints, and the inverse transformation angular velocity $\dot{\varepsilon}_{i\ Inv}$ of the articulated joints then being integrated, in an angular velocity calculation stage designed as an integration stage, over a constant time interval, to form target values of the articulating angles of the joints, defining the target posture values $PS_i$, the controller assembly being configured to include a distributor boom control routine which receives target posture values $PI_i$, from an input routine, in the form of actual values of the articulating angles $\varepsilon_i$ of the joints determined by the angle determining device, and which determines regulated positioning control variables $SD_i$ for the actuating elements of the drive units, based on the actual posture values $PI_i$ and the target posture values $PS_i$, using a control loop, the positioning control variables being converted, in an output routine, into the control signals $SW_i$ for the actuating elements of the drive units.

5. The large manipulator according to claim 1 wherein the vertical speed determining device determines the speed of the boom tip.

6. The large manipulator according to claim 1 wherein the vertical speed determining device includes a speed sensor and/or acceleration sensor arranged on the boom arm, and/or an angle sensor that records the position of the boom arm with respect to the direction of gravity.

7. The large manipulator according to claim 1 wherein the boom pedestal is arranged on a frame and is rotatable about a vertical axis, the control apparatus controlling a rotary movement of the boom pedestal about the vertical axis with at least one actuating element of a drive unit associated with the boom pedestal, wherein a horizontal speed determining device for determining the horizontal speed v⊥ of a boom arm location in a plane perpendicular to the vertical axis and in a coordinate system referenced to the frame, as well as an angle of rotation determining device for determining the angle of rotation $\varepsilon_{18}$ of the boom pedestal about the vertical axis is provided, and wherein the control apparatus controls the movement of the articulated boom by providing positioning control variables $SD_{90}$ for the at least one actuating element for the drive unit associated with the boom pedestal, the positioning control variables being a function of a horizontal speed v⊥ of the boom arm location determined by the horizontal speed determining device, and on control signals S for adjusting the distributor boom that are generated by the angle of rotation determining device and the boom operator controller.

8. A large manipulator for concrete pumps, comprising:

a boom pedestal arranged on a frame, the boom pedestal being rotatable relative to the frame about a vertical axis, a distributor boom which comprises an articulated boom which is mounted on the boom pedestal and includes a plurality of boom arms connected to one another in an articulated manner and having a boom tip, and a plurality of articulated joints for pivoting the boom arms about horizontal and mutually parallel articulating axes with respect to the boom pedestal or an adjacent one of the plurality of boom arms, and a control apparatus which controls the movement of the articulated boom about the vertical axis with the aid of an actuating element of a drive unit associated with the boom pedestal, a horizontal speed determining device for determining a horizontal speed v⊥ of a boom arm location in a plane perpendicular to the vertical axis and in a coordinate system referenced to the frame, and an angle of rotation determining device for determining the angle of rotation $\varepsilon_{18}$ of the boom pedestal about the vertical axis, wherein the control apparatus controls the movement of the articulated boom by providing positioning control variables $SD_{90}$ for the at least one actuating element of the drive unit associated with the boom pedestal, the positioning control variables being a function of the horizontal speed v⊥ of the boom arm location determined by the horizontal speed determining device and control signals S for adjusting the distributor boom that are generated by the angle of rotation determining device and a boom operator controller that can be operated by a boom operator, and a controller assembly having a controller which is coupled to the horizontal speed determining device and to an angle determining device which determines the articulating angles εi of the articulated joints and wherein the controller assembly controls actuating elements for a plurality of articulated joint drive units respectively associated with the plurality of articulated joints and which is configured to run a distributor boom damping routine which determines:

(i) a damping force $F_D\perp$ based on the horizontal speed of the boom arm location determined by the horizontal speed determining device; and (ii) damping control variables $DS_i$ for the drive unit associated with the boom pedestal for damping the articulated boom, wherein the damping control variables $DS_i$ are a function of said damping force $F_D\perp$, the articulating angles $\varepsilon_i$ determined by the angle determining device, and known physical variables of the distributor boom, and wherein the damping control variables are used in determining the positioning control variables $SD_{90}$ for controlling the at least one actuating element of the drive unit associated with the boom pedestal, wherein the distributor boom damping routine determines a target damping force $F_D\perp$ or a target damping torque $M_D\perp$=v⊥ D⊥ based on the horizontal speed v⊥ of the boom arm location in the plane perpendicular to the axis of rotation of the boom pedestal, and the controller assembly determines an actual force $F_i$ generated by the drive unit or an actual torque $M_i$ generated by the drive unit, wherein the distributor boom damping routine includes a control stage that determines the damping control variables $DS_i$ for the drive unit for damping the distributor boom, based on a comparison between the actual force $F_i$ generated by the drive unit and the target component damping force $FD_i$ to be generated, or based on a comparison of the actual torque $M_i$ generated by the drive unit and the target component damping torque $MD_i$ to be generated, wherein the controller assembly is configured to run a distributor boom target posture value routine which converts the control signals S of the boom operator controller into target posture values $PS_i$ in the form of target values of the angle of rotation $\varepsilon_{18}$ of the boom pedestal about the vertical axis, wherein the controller assembly is configured to run a distributor boom control routine which determines the positioning control variables $SD_{90}$ for the actuating element of the drive unit based on actual posture values $PI_i$ in the form of actual values, supplied to the controller assembly, of the angle of rotation $\varepsilon_{18}$ of the boom pedestal about the vertical axis and the target posture values $PS_i$, and wherein the controller assembly is configured to run a superimposition routine for superimposing the damping control variables $DS_{90}$ and the positioning control variables $SD_{90}$ to form control signals $SW_{90}$ for the actuating element of the drive unit.

9. A large manipulator for concrete pumps, comprising:

a boom pedestal arranged on a frame, the boom pedestal being rotatable relative to the frame about a vertical axis, a distributor boom which comprises an articulated boom which is mounted on the boom pedestal and includes a plurality of boom arms connected to one another in an articulated manner and having a boom tip, and a plurality of articulated joints for pivoting the boom arms about horizontal and mutually parallel articulating axes with respect to the boom pedestal or an adjacent one of the plurality of boom arms, and a control apparatus which controls the movement of the articulated boom about the vertical axis with the aid of an actuating element of a drive unit associated with the boom pedestal, a horizontal speed determining device for determining a horizontal speed v⊥ of a boom arm location in a plane perpendicular to the vertical axis and in a coordinate system referenced to the frame, and an angle of rotation determining device for determining the angle of rotation $\varepsilon_{18}$ of the boom pedestal about the vertical axis, wherein the control apparatus controls the movement of the articulated boom by providing control signals $SW_{90}$ for the at least one actuating element for the drive unit associated with the boom pedestal, which positioning control variables are determined as a function of the horizontal speed v⊥ of the boom arm location determined by the horizontal speed determining device, and on control signals S for adjusting the distributor boom that are generated by the angle of rotation determining device and a boom operator controller that can be operated by a boom operator, wherein the control apparatus has a controller assembly with a controller and the controller assembly calculates the actual torque $M_{18}$ generated by the drive unit, wherein the boom operator controller supplies the controller assembly with control signals S which are converted, in the controller assembly, into target posture values $PS_{18}$ in the form of target values of the angle of rotation $\varepsilon_{18}$ of the boom pedestal about the vertical axis, and wherein the controller assembly is configured to run a distributor boom horizontal damping routine wherein the determined actual torque $M_{18}$, generated by the drive unit, and the determined horizontal speed v⊥ of the boom arm location and the determined angle of rotation $\varepsilon_{18}$ of the boom pedestal about the vertical axis, are all continuously supplied to the distributor boom horizontal damping routine, and wherein the distributor boom horizontal damping routine:

determines, based on the supplied actual torques $M_{i8}$, and the supplied angles of rotation $\varepsilon_{18}$ of the boom pedestal about the vertical axis, as well as known physical variables of the distributor boom, a vertical horizontal force F⊥ acting on the boom arm location, converts the horizontal force F⊥ acting on the boom arm location into a horizontal target speed $v\perp_{Target}$ of the boom arm location, determines a horizontal comparison value Δv⊥ based on the horizontal target speed $v\perp_{Target}$ of the boom arm location and the determined horizontal speed v⊥ of the boom arm location, converts the horizontal comparison value Δv⊥, using an inverse transformation on the basis of the supplied angle of rotation $\varepsilon_{18}$ of the boom pedestal about the vertical axis and on the basis of known physical variables of the distributor boom, into an inverse transformation angular velocity $\dot{\varepsilon}_{18Inv}$ of the angle of rotation $\varepsilon_{18}$ of the boom pedestal about the vertical axis, and the inverse transformation angular velocity $\dot{\varepsilon}_{18Inv}$ of the angle of rotation $\varepsilon_{18}$ of the boom pedestal about the vertical axis is integrated, in an angular velocity calculation stage designed as an integration stage, over a constant time interval, to form a target value of the angle of rotation $\varepsilon_{18}$ defining the target posture values $PS_{18}$, wherein the controller assembly is configured to run a distributor boom control routine which receives actual posture values $PI_{18}$, from an input routine, in the form of actual values from the angle of rotation determining device, and determining, using a control loop, controlled posture values $PG_{18}$, as positioning control variables $SD_{18}$, based on the actual posture values $PI_{18}$ and the target posture values $PS_{18}$, wherein the controlled posture values are converted, in an output routine, into the control signals $SW_{90}$ for the actuating element of the drive unit associated with the boom pedestal.

10. The large manipulator according to claim 9 wherein the boom arm location is a boom tip of the articulated boom.

11. The large manipulator according to claim 9 wherein the horizontal speed determining device includes a speed sensor and/or acceleration sensor arranged on the boom arm, and/or an angle sensor that records the angle of rotation of the boom pedestal about the vertical axis.

12. A method for damping mechanical vibrations of an articulated boom of a large manipulator for concrete pumps, comprising:

providing a distributor boom which comprises an articulated boom mounted on a boom pedestal and including a plurality of boom arms connected to one another in an articulated manner and having a boom tip, and a plurality of articulated joints for pivoting the boom arms about horizontal and mutually parallel articulating axes with respect to the boom pedestal or an adjacent boom arm, and providing a control apparatus which controls the movement of the articulated boom with the aid of actuating elements for a plurality of drive units respectively associated with the plurality of articulated joints, determining with the control apparatus a vertical speed $v_{||}$ of a boom arm location in a plane parallel with the articulated boom and in a coordinate system referenced to the frame, determining with the control apparatus the articulating angles of the plurality of articulated joints, and generating positioning control variables $SD_i$ for the actuating elements of the drive units with the control apparatus, wherein the positioning control variables are a function of a vertical speed $v_{||}$ of a boom arm location determined by a vertical speed determining device for determining a vertical speed $v_{||}$ of a boom arm location, articulating angles $\varepsilon_i$ of the plurality of articulating joints determined by an angle determining device for determining the articulating angles of the plurality of plurality of articulating joints, and on control signals S for adjusting the distributor boom generated by a boom operator controller that can be operated by a boom operator, and wherein:

(i) a damping force $F_{D||}$ is determined based on the vertical speed $v_{||}$ determined for the boom arm location;

(ii) the damping force $F_{D||}$ determined is divided into component damping forces associated with the individual articulated joints; and (iii) damping control variables $DS_i$ for controlling the drive unit actuating elements for damping the articulated boom are provided, wherein the damping control variables are determined as a function of the component damping forces, the determined articulating angles $\varepsilon_i$ for the drive units associated with the articulated joints, known physical variables of the distributor boom for damping the boom arms, and wherein the damping control variables are used in the determination of the positioning control variables $SD_i$ for the actuating elements of the drive units, wherein a target component damping force $FD_i$ or a target component damping torque $MD_i$ that can be generated by the drive unit associated with a joint, is determined based on the component damping force associated with one of the plurality of joints and based on the articulating angle determined for that joint, wherein an actual force $F_i$ or an actual torque $M_i$ generated the drive unit associated with the joint is determined, wherein the damping control variables $DS_i$ for damping the distributor boom are determined based on a comparison between the actual force $F_i$ generated by the drive unit and the target component damping force $FD_i$ to be generated, or based on a comparison between the actual torque $M_i$ generated by the drive unit and the target component damping torque $MD_i$ to be generated, wherein the control signals S of the boom operator controller are converted into target posture values $PS_i$ in the form of target values of the articulating angles $\varepsilon_i$ of the joints of the distributor boom, wherein the positioning control variables $SD_i$ for the actuating elements of the drive units are determined based on actual posture values $PI_i$ in the form of actual values of the articulating angles $\varepsilon_i$ of the joints of the distributor boom and the target posture values $PS_i$, and wherein the damping control variables $DS_i$ and the positioning control variables $SD_i$ are superimposed to form control signals $SW_i$ for the actuating elements of the drive units.

13. A method for damping mechanical vibrations of an articulated boom of a large manipulator for concrete pumps, comprising:

providing a distributor boom which comprises an articulated boom which is mounted on a boom pedestal and includes a plurality of boom arms connected to one another in an articulated manner and having a boom tip, and a plurality of articulated joints for pivoting the boom arms about horizontal and mutually parallel articulating axes with respect to the boom pedestal or an adjacent one of the plurality of boom arms, controlling movement of the articulated boom with the aid of actuating elements for a plurality of drive units respectively associated with the plurality of articulated joints, determining a vertical speed $v_{||}$ of a boom arm location in a plane parallel with the articulated boom and in a coordinate system referenced to the frame, determining the articulating angles $\varepsilon_i$ of the plurality of articulated joints, and generating positioning control variables $SD_i$ for the actuating elements of the plurality of drive units, wherein the positioning control variables are a function of a vertical speed $v_{||}$ of a boom arm location determined by a vertical speed determining device for determining a vertical speed $v_{||}$ of a boom arm location, the articulating angles $\varepsilon_i$ of the plurality of articulated joints determined with an angle determining device for determining the articulating angles of the joints, and control signals S for adjusting the distributor boom generated by a boom operator controller that can be operated by a boom operator, determining the actual forces $F_i$ or actual torques $M_i$ generated by the drive units, determining a vertical force $F_{||}$ acting on the boom arm location as a function of the actual forces $F_i$ or actual torques $M_i$ which have been determined and the articulating angles $\varepsilon_i$ determined for the joints, and known physical variables of the distributor boom, the vertical speed $v_{||}$ of a boom arm location on at least one boom arm is determined, and the vertical force $F_{||}$ acting on the boom arm location is converted into a vertical target speed $v_{||Target}$ of the boom arm location;

a vertical comparison value $\Delta v_{||}$ is determined based on the target vertical speed $v_{||Target}$ of the boom arm location and the vertical speed $v_{||}$ determined for the boom arm location, and the vertical comparison value $\Delta v_{||}$ is converted, using an inverse transformation based on the determined articulating angles $\varepsilon_i$ of the joints and based on known physical variables of the distributor boom into an inverse transformation angular velocity $\dot{\varepsilon}_{i\ Inv}$ of the articulated joints, and the inverse transformation angular velocities $\dot{\varepsilon}_{i\ Inv}$ of the articulated joints are integrated, over a constant time interval, to form target values of the articulating angles $\varepsilon_i$ of the joints defining the target posture values $PS_i$, wherein the positioning control variables $SD_i$ for the actuating elements of the drive units are determined, using a control loop, based on the actual posture values $PI_i$ and the target posture values $PS_i$, and then being converted into control signals for the actuating elements of the drive units.

14. The method according to claim 13 wherein the vertical speed $v_{\|}$ of the boom tip is determined as the vertical speed $v_{\|}$ of a boom arm location.

15. A method for damping mechanical vibrations of an articulated boom in a large manipulator for concrete pumps, comprising:

providing a boom pedestal arranged on a frame, the boom pedestal being rotatable relative to the frame about a vertical axis, providing a distributor boom which comprises an articulated boom which is mounted on the boom pedestal and includes a plurality of boom arms connected to one another in an articulated manner and having a boom tip, and a plurality of articulated joints for pivoting the boom arms about horizontal and mutually parallel articulating axes with respect to the boom pedestal or an adjacent one of the boom arms, and providing a control apparatus which controls the movement of the articulated boom about the vertical axis with the aid of an actuating element of a drive unit associated with the boom pedestal, determining a horizontal speed v⊥ of a boom arm location, in a plane perpendicular to the vertical axis and in a coordinate system referenced to the frame, and determining articulating angles $\varepsilon_i$ of the plurality of articulated joints, and controlling the movement of the articulated boom by providing positioning control variables $SD_{90}$ for the at least one actuating element of the drive unit associated with the boom pedestal, wherein the positioning control variables are a function of the horizontal speed v⊥ of the boom arm location determined by a horizontal speed determining device for determining a horizontal speed v⊥, control signals S for adjusting the distributor boom that are generated by an angle of rotation determining device which determines the angle of rotation $\varepsilon_{18}$ of the boom pedestal about the vertical axis and a boom operator controller that can be operated by a boom operator, and wherein (i) a damping force $F_{D\|}$ is determined based on the determined horizontal speed v⊥; and (ii) damping control variables $DS_i$, for damping the articulated boom, are determined based on said damping force $F_D\perp$, and based on the articulating angles $\varepsilon_i$ determined for the drive units associated with the articulated joints, and based on known physical variables of the distributor boom, and wherein the damping control variables are used in determining the positioning control variables $SD_{90}$ for controlling the at least one actuating element of the drive unit associated with the boom pedestal, wherein a target damping force $F_D\perp$ or a target damping torque $M_D\perp$=v⊥ D⊥ is determined based on the horizontal speed v⊥ of the boom arm location in the plane perpendicular to the axis of rotation of the boom pedestal, and wherein an actual force $F_i$ generated by the drive unit or an actual torque $M_i$ generated by the drive unit is determined, wherein the damping control variables $DS_i$ for damping the distributor boom are determined based on a comparison between the actual force $F_i$ generated by the drive unit and the target component damping force $FD_i$ to be generated, or based on a comparison between the actual torque $M_i$ generated by the drive unit and the target component damping torque $MD_i$ to be generated, wherein the control signals S of the boom operator controller are converted into target posture values $PS_i$ in the form of target values of the angle of rotation $\varepsilon_{18}$ of the boom pedestal about the vertical axis, wherein the positioning control variables $SD_{90}$ for the actuating element of the drive unit are determined based on actual posture values $PI_i$ in the form of actual values of the angle of rotation $\varepsilon_{18}$ of the boom pedestal about the vertical axis and the target posture values $PS_i$, and wherein the damping control variables $DS_{90}$ and the positioning control variables $SD_{90}$ are superimposed to form control signals $SW_{90}$ for the actuating element of the drive unit.

16. A method for damping mechanical vibrations of an articulated boom in a large manipulator for concrete pumps, comprising:

providing a boom pedestal that is arranged on a frame, the boom pedestal being rotatable relative to the frame about a vertical axis, providing a distributor boom which comprises an articulated boom which is mounted on the boom pedestal and includes a plurality of boom arms connected to one another in an articulated manner and having a boom tip, and a plurality of articulated joints for pivoting the boom arms about horizontal and mutually parallel articulating axes with respect to the boom pedestal or an adjacent one of the boom arms, controlling the movement of the articulated boom about the vertical axis with the aid of an actuating element of a drive unit associated with the boom pedestal, wherein a horizontal speed v⊥ of a boom arm location is determined in a plane perpendicular to the vertical axis and in a coordinate system referenced to the frame, wherein the articulating angles of the articulated joints are determined, and wherein the movement of the articulated boom is controlled by providing positioning control variables $SD_{90}$ for the at least one actuating element for the drive unit associated with the boom pedestal, wherein the positioning control variables are a function of a horizontal speed v⊥ of the boom arm location determined by a horizontal speed determining device for determining a horizontal speed v⊥, and control signals S for adjusting the distributor boom that are generated by an angle of rotation determining device for determining the angle of rotation $\varepsilon_{18}$ of the boom pedestal about the vertical axis, and by a boom operator controller that can be operated by a boom operator, wherein the actual force $F_i$ generated by means of the drive unit associated with the boom pedestal or the actual torque $M_i$ generated by means of the drive unit associated with the boom pedestal is determined, the horizontal speed v⊥ of a boom arm location on at least one boom arm is determined, and the articulating angles $\varepsilon_i$ of the articulated joints and the angle of rotation $\varepsilon_{18}$ of the boom pedestal about the vertical axis thereof are determined, a horizontal force F⊥ acting on the boom arm location is determined based on the actual force $F_i$ or the actual torque $M_i$ supplied and the articulating angles $\varepsilon_i$ supplied for the joints, as well as known physical variables of the distributor boom, the horizontal force $F\perp$ acting on the boom arm location is converted into a horizontal target speed $v\perp_{Target}$ of the boom arm location, wherein a horizontal comparison value $\Delta v\perp$ is determined based on the horizontal target speed $v\perp_{Target}$ of the boom arm location and the horizontal speed $v\perp$ determined for the boom arm location, wherein the horizontal comparison value $\Delta v\perp$ is converted, by means of an inverse transformation on the basis of the angle of rotation $\varepsilon_{18}$ supplied for the boom pedestal about the vertical axis and on the basis of known physical variables of the distributor boom, into an inverse transformation angular velocity $\dot{\varepsilon}_{18Inv}$ of the boom pedestal about the vertical axis thereof, and the inverse transformation angular velocity $\dot{\varepsilon}_{18Inv}$ of the angle of rotation $\varepsilon_{18}$ of the boom pedestal about the vertical axis is integrated, over a constant time interval, to form a target value of the angle of rotation $\varepsilon_{18}$ defining the target posture value $PS_{18}$, wherein controlled posture values $SD_{18}$, in the form of positioning control variables $SD_{18}$, for the drive unit associated with the boom pedestal are determined based on the actual posture values $PI_{18}$ and the target posture values $PS_{18}$ using a control loop, and are converted into control signals $SW_{90}$ for the actuating element of the drive unit associated with the boom pedestal.

17. The method according to claim 16, wherein the horizontal speed $v\perp$ of the boom tip is determined as the horizontal speed $v\perp$ of a boom arm location.

* * * * *